US010961802B2

(12) United States Patent
Guidry

(10) Patent No.: US 10,961,802 B2
(45) Date of Patent: Mar. 30, 2021

(54) FRAC STACK WELL INTERVENTION

(71) Applicant: Cameron International Corporation, Houston, TX (US)

(72) Inventor: Kirk P. Guidry, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 72 days.

(21) Appl. No.: 16/440,344

(22) Filed: Jun. 13, 2019

(65) Prior Publication Data

US 2020/0032609 A1 Jan. 30, 2020

Related U.S. Application Data

(63) Continuation-in-part of application No. 15/837,176, filed on Dec. 11, 2017.

(60) Provisional application No. 62/433,923, filed on Dec. 14, 2016.

(51) Int. Cl.

| | |
|---|---|
| ***E21B 33/072*** | (2006.01) |
| ***E21B 33/06*** | (2006.01) |
| ***E21B 43/26*** | (2006.01) |

(52) U.S. Cl.

CPC ..... *E21B 33/072* (2013.01); *E21B 33/062* (2013.01); *E21B 43/26* (2013.01)

(58) Field of Classification Search

None

See application file for complete search history.

(56) References Cited

U.S. PATENT DOCUMENTS

| | | | |
|---|---|---|---|
| 2,224,446 | A | 12/1940 | Penick et al. |
| 2,238,357 | A | 4/1941 | Allen |
| 2,427,073 | A | 9/1947 | Schweitzer |
| 2,923,310 | A | 2/1960 | Eckert |
| 3,102,709 | A | 9/1963 | Allen |
| 3,159,378 | A | 12/1964 | Haag |
| 3,333,816 | A | 8/1967 | Williams et al. |
| 4,089,532 | A | 5/1978 | Kamyshnikov et al. |
| 4,214,605 | A | 7/1980 | Hardgrave |
| 4,541,608 | A | 9/1985 | Forester et al. |
| 5,005,802 | A | 4/1991 | McWhorter et al. |
| 5,013,005 | A | 5/1991 | Nance |
| 5,819,851 | A | 10/1998 | Dallas |
| 6,164,619 | A | 12/2000 | Van Winkle et al. |
| 6,244,336 | B1 | 6/2001 | Kachich |
| 6,289,993 | B1 | 9/2001 | Dallas |

(Continued)

OTHER PUBLICATIONS

Cameron General Catalog 1962-1963, Cameron Iron Works, Inc., Houston, Texas, cover and p. 1112 (2 pages).

(Continued)

*Primary Examiner* — Daphne M Barry

(74) *Attorney, Agent, or Firm* — Eubanks PLLC

(57) ABSTRACT

A fracturing system having rams for controlling flow through a fracturing tree is provided. In one embodiment, a well intervention method includes injecting fracturing fluid into a well through a bore of a frac stack coupled to a wellhead. The frac stack includes rams that can be moved between open and closed positions to control flow through the bore. The well intervention method also includes coupling a lubricator to the frac stack without a blowout preventer between the lubricator and the frac stack and lowering an intervention tool from the lubricator through the bore of the frac stack and into the well. Additional systems, devices, and methods for fracturing and intervention are also disclosed.

19 Claims, 17 Drawing Sheets

(56) References Cited

U.S. PATENT DOCUMENTS

| | | | |
|---|---|---|---|
| 6,296,225 | B1 | 10/2001 | Watts |
| 6,719,262 | B2 | 4/2004 | Whitby et al. |
| 7,207,382 | B2 | 4/2007 | Schaeper |
| 8,573,557 | B2 | 11/2013 | Carbaugh et al. |
| 9,115,562 | B2 | 8/2015 | Guidry et al. |
| 9,249,643 | B2 | 2/2016 | Melancon |
| 9,777,546 | B2 | 10/2017 | Hoover et al. |
| 10,233,716 | B2 | 3/2019 | van Wijk et al. |
| 2006/0113501 | A1 | 6/2006 | Isaacks et al. |
| 2006/0254822 | A1 | 11/2006 | Ayling |
| 2011/0030963 | A1 | 2/2011 | Demong et al. |
| 2013/0153237 | A1 | 6/2013 | McGuire |
| 2018/0163501 | A1 | 6/2018 | Guidry |

OTHER PUBLICATIONS

Christopherson et al., U.S. Appl. No. 16/440,408, filed Jun. 13, 2019.

FRAC STACK WELL INTERVENTION

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in searching for and extracting oil, natural gas, and other subterranean resources from the earth. Particularly, once a desired subterranean resource is discovered, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling or extraction operations.

Additionally, such wellhead assemblies may use a fracturing tree and other components to facilitate a fracturing process and enhance production from a well. As will be appreciated, resources such as oil and natural gas are generally extracted from fissures or other cavities formed in various subterranean rock formations or strata. To facilitate extraction of such resources, a well may be subjected to a fracturing process that creates one or more man-made fractures in a rock formation. This facilitates, for example, coupling of pre-existing fissures and cavities, allowing oil, gas, or the like to flow into the wellbore. Such fracturing processes typically include injecting a fracturing fluid—which is often a mixture including sand and water—into the well to increase the well's pressure and form the man-made fractures. During fracturing operations, fracturing fluid may be routed via fracturing lines (e.g., pipes) to fracturing trees installed at wellheads. Conventional fracturing trees have valves that can be opened and closed to control flow of fluid through the fracturing trees into the wells.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

At least some embodiments of the present disclosure generally relate to fracturing systems using rams to control fluid flow through a fracturing tree during fracturing operations. In some embodiments, the fracturing tree includes a frac stack body having ram cavities provided along a bore. Rams in the ram cavities can be opened and closed to control fracturing fluid and pressure in the fracturing tree. The fracturing tree and its components can include various features to reduce erosive wear of seals of the rams from fracturing fluid flowing through the tree. For example, in certain embodiments, a protective sleeve can be included to cover the ram cavities during fracturing. Additionally, rams of a frac stack can be used to seal around a tool line during well intervention in some embodiments.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
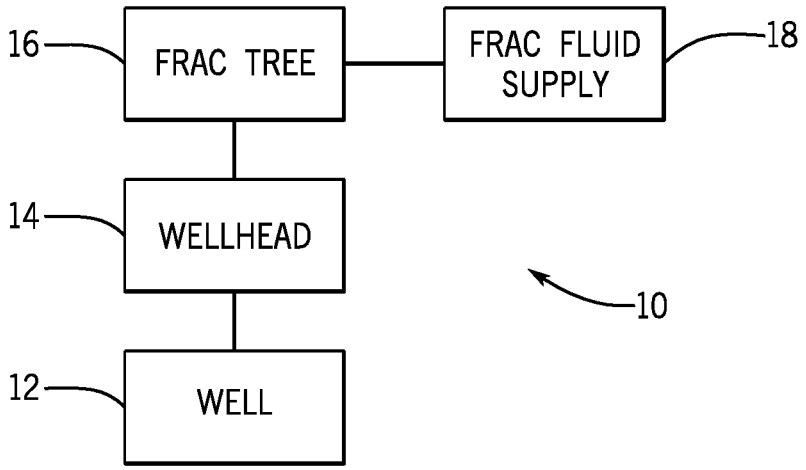
FIG. 1 generally depicts a fracturing system having a fracturing tree in accordance with an embodiment of the present disclosure.
Figure 2:
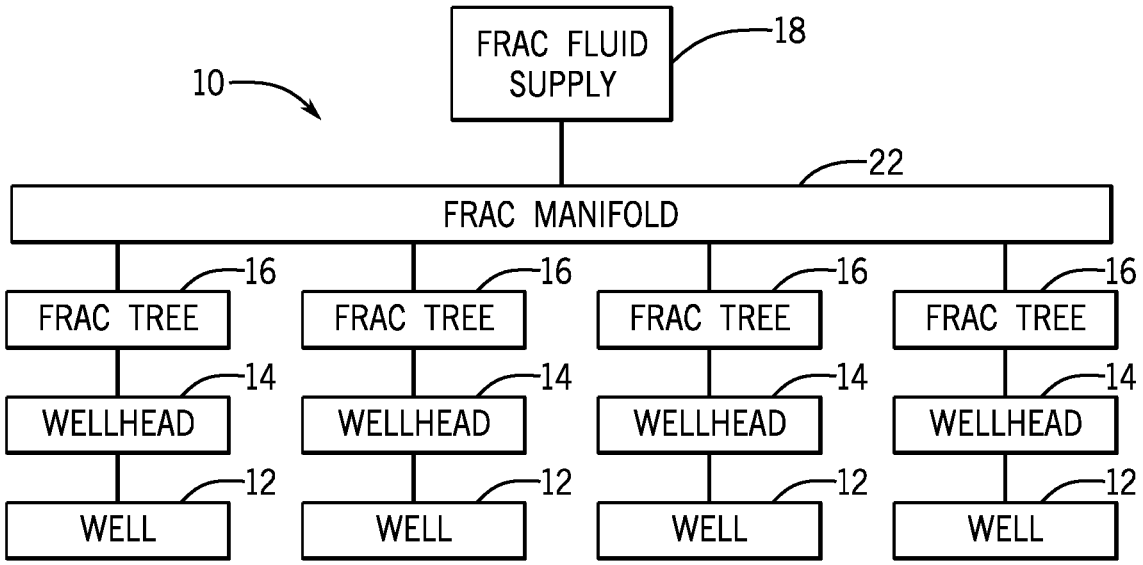
FIG. 2 is a block diagram of the fracturing system of FIG. 1 with a fracturing manifold coupled to multiple fracturing trees in accordance with one embodiment.

Turning now to the present figures, examples of a fracturing system 10 are provided in FIGS. 1 and 2 in accordance with certain embodiments. The fracturing system 10 facilitates extraction of natural resources, such as oil or natural gas, from a subterranean formation via one or more wells 12 and wellheads 14. Particularly, by injecting a fracturing fluid into a well 12, the fracturing system 10 increases the number or size of fractures in a rock formation or strata to enhance recovery of natural resources present in the formation. Wells 12 are surface wells in some embodiments, but it will be appreciated that resources may be extracted from other wells 12, such as platform or subsea wells.

The fracturing system 10 includes various components to control flow of a fracturing fluid into the well 12. For instance, the fracturing system 10 depicted in FIG. 1 includes a fracturing tree 16 that receives fracturing fluid from a fluid supply 18. In some embodiments, the fracturing fluid supply 18 is provided by trucks that pump the fluid to fracturing trees 16, but any suitable sources of fracturing fluid and manners for transmitting such fluid to the fracturing trees 16 may be used. Moreover, the fluid supply 18 may be connected to a fracturing tree 16 directly or via a fracturing manifold 22, as generally depicted in FIG. 2. The fracturing manifold 22 can include conduits, such as pipes, as well as valves or sealing rams to control flow of fracturing fluid to the fracturing trees 16 (or from the fracturing trees 16, such as during a flowback operation). As depicted in FIG. 2, the fracturing manifold 22 is connected to provide fracturing fluid to multiple fracturing trees 16, which may then be routed into respective wells 12 via wellheads 14. But it is noted that the fracturing manifold 22 may instead be coupled to a single fracturing tree 16.

Figure 3:
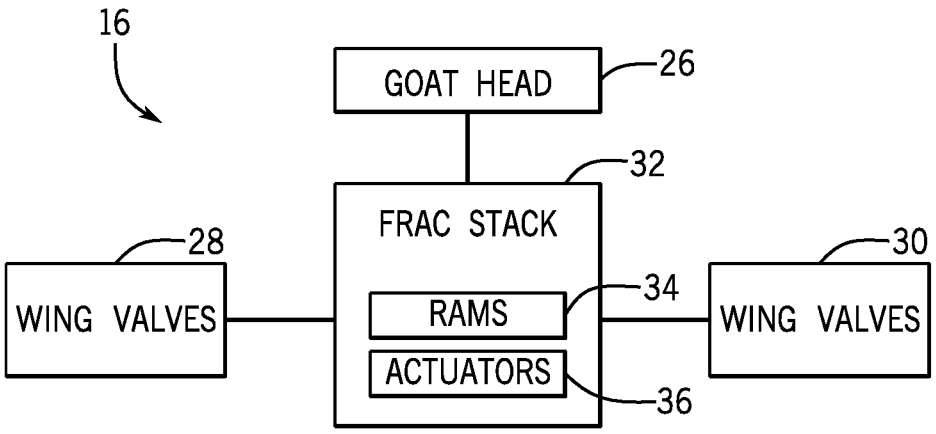
FIG. 3 is a block diagram showing components of the fracturing tree of FIG. 1, including a frac stack having rams for controlling flow through the fracturing tree, in accordance with one embodiment.

Fracturing trees have traditionally included valves (e.g., gate valves) that control flow of fracturing fluid to and from wells through the trees. In at least some embodiments of the present disclosure, however, the fracturing trees 16 use sealing rams instead of valves to control flow through the trees. One example of such a fracturing tree 16 is depicted in FIG. 3 as including a goat head 26, wing valves 28 and 30, and a fracturing stack ("frac stack") 32. The goat head 26 includes one or more connections for coupling the fracturing tree 16 in fluid communication with fluid supply 18, such as via fracturing manifold 22. This allows fracturing fluid from the fluid supply 18 to enter the fracturing tree 16 through the goat head 26 and then flow into the frac stack 32. When included, the wing valves 28 and 30 can take any of various forms. In one embodiment, for example, the wing valves 28 include pumpdown valves for controlling flow of a pumpdown fluid into the frac stack 32 and the wing valves 30 include valves for controlling flowback fluid exiting the well 12 through the wellhead 14 and the frac stack 32. In some other embodiments, either the wing valves 28 or the wing valves 30 could be omitted and the remaining wing valves (or even a single remaining wing valve) 28 or 30 could be used at different times for controlling flow of both pumpdown fluid and flowback fluid.

Figure 4:
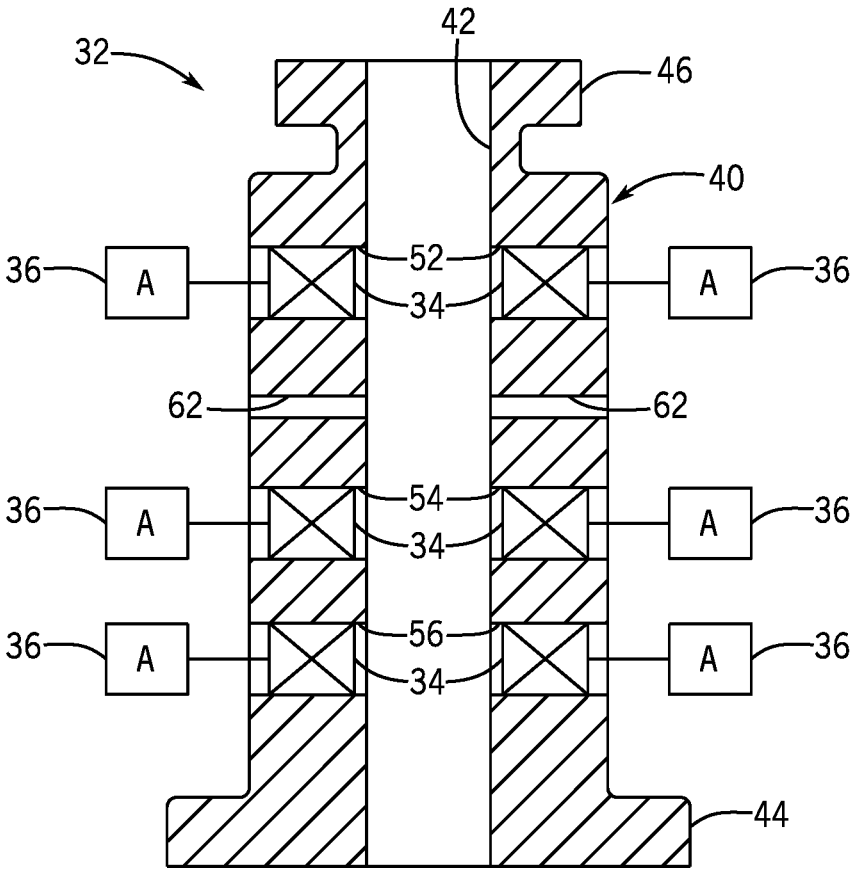
FIG. 4 is a schematic depicting the frac stack of FIG. 3 as having rams disposed in a body of the frac stack in accordance with one embodiment.

The frac stack 32 includes rams 34 that can be used to control flow of the fracturing fluid through the fracturing tree 16 (e.g., into a wellhead 14 and well 12). The frac stack 32 also includes actuators 36 for controlling opening and closing of the rams 34. One example of a frac stack 32 is depicted in FIG. 4 as having a hollow main body 40 with a bore 42 for conveying fluid through the body 40. The frac stack main body 40 also includes flanges 44 and 46 to facilitate connection of the body 40 to other components. For example, the main body 40 can be mounted on a wellhead 14 with the lower flange 44 and connected to the goat head 26 with the upper flange 46. The main body 40 can be fastened directly to the wellhead 14 and the goat head 26 in some embodiments, though in others the body 40 can be coupled to the wellhead 14 or the goat head 26 via an intermediate component, such as an adapter spool or a blowout preventer that is installed between the fracturing tree 16 and the wellhead 14.

In at least some embodiments, flow of fracturing fluid through the fracturing tree 16 and into the well 12 is controlled with rams 34 of the fracturing tree 16, and the fracturing tree 16 does not include a valve for controlling flow of fracturing fluid pumped through the fracturing tree 16 into the well 12. Further, in at least one such embodiment, the fracturing system 10 also does not include a valve between the fracturing tree 16 and the well 12 for controlling flow of fracturing fluid pumped into the well 12 through the fracturing tree 16.

The frac stack body 40 is depicted in FIG. 4 as having three pairs of opposing ram cavities—namely, ram cavities 52, 54, and 56—with installed rams 34 that are controlled by actuators 36. In other instances, however, the frac stack body 40 can have a different number of ram cavities. Rams are installed in the frac stack body 40 with keyed engagement in some embodiments to maintain desired orientation of the rams. For example, the rams may include keys that fit within slots along the ram cavities, or the ram cavities may include keys that fit within slots in the rams.

The frac stack main body 40 is also shown in FIG. 4 as including conduits 62 for routing fluid between the bore 42 and other components external to the body, such as the wing valves 28 and 30, which can be coupled to the body 40 in-line with the conduits 62. The body 40 can include valve flats or any other suitable features to facilitate attachment of the wing valves to the body. In some embodiments, a pumpdown fluid can be pumped into the bore 42 and then into a well 12 through one of the conduits 62 and flowback fluid from the well 12 can flow into the bore 42 and out of the frac stack body 40 through the other conduit 62. In another embodiment, pumpdown fluid can be pumped into the bore 42 and the flowback fluid can flow out of the bore 42 at different times through the same conduit 62. Flow through that conduit 62 may be controlled with one or more valves, such as a wing valve 28 or 30. In such cases, the body 40 may include just a single conduit 62, but other embodiments can include a different number of conduits 62. Further, conduits 62 can be provided at different axial positions along the body 40 in some instances. For example, one conduit 62 can be provided through the body 40 between ram cavities 52 and 54 (as depicted in FIG. 4), while another conduit 62 could be provided through the body 40 between the ram cavities 54 and 56. This would allow the rams in ram cavities 54 to selectively isolate the conduits 62 from one another to provide further control of flow through the body 40.

Figure 5:
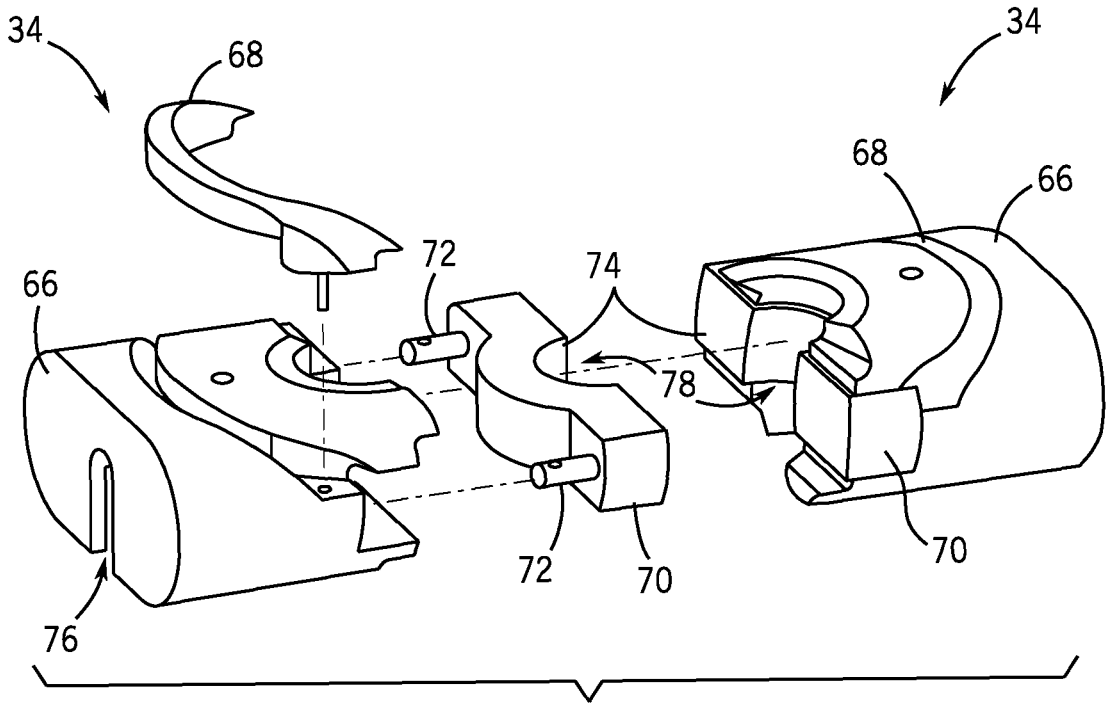
FIGS. 5 and 6 depict examples of rams that can be used in a fracturing tree, such as within the frac stack body of FIG. 4, in accordance with some embodiments.
Figure 6:
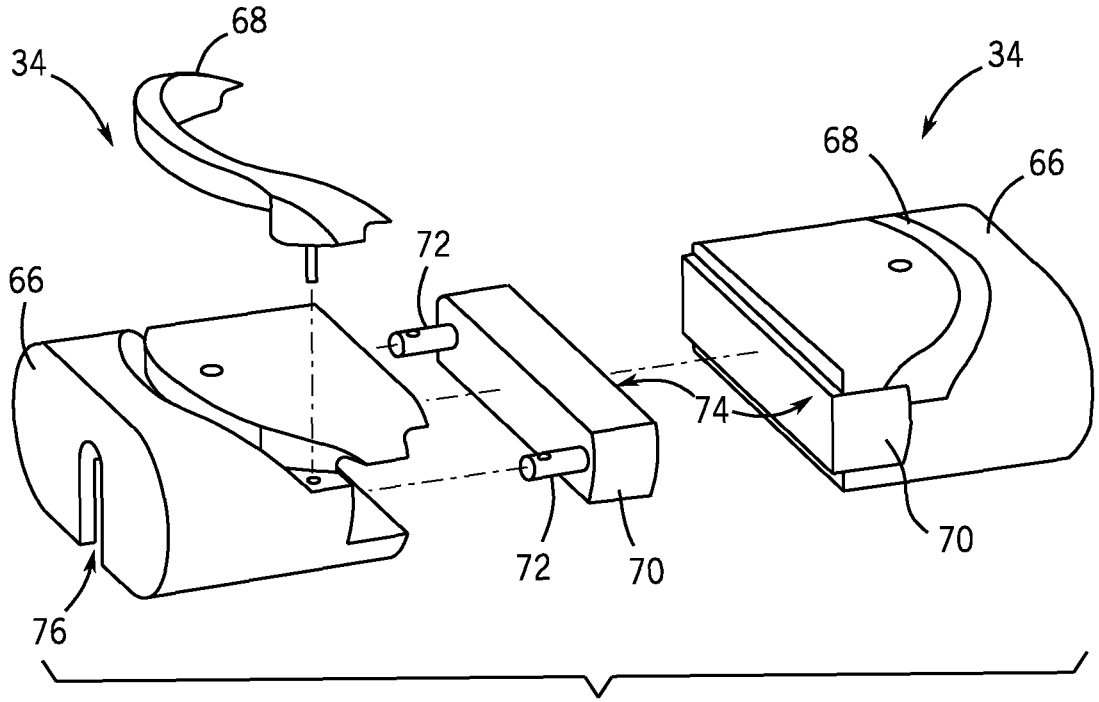

The frac stack 32 can include any suitable rams 34 and actuators 36. For example, the rams 34 can include blind rams, pipe rams, gate-style rams, or shear rams, and the actuators 36 could be electric, hydraulic, or electro-hydraulic actuators. Two examples of rams 34 that can be used in the frac stack body 40 are depicted in FIGS. 5 and 6. More particularly, the rams 34 are depicted as pipe rams in FIG. 5, with each ram 34 including a body or ram block 66, a ram seal 68 (here shown as a top seal), and a ram packer 70. The ram seal 68 and the ram packer 70 include elastomeric materials that facilitate sealing by the ram 34 in the frac stack main body 40. The ram packer 70 includes alignment pins 72 that are received in corresponding slots of the ram block 66 when the ram packer 70 is installed. The ram packers 70 include sealing surfaces 74 and recesses 78 that allow a pair of opposing pipe rams 34 to close about and seal against a tubular member, such as a pipe. The recesses 78 may be sized according to the diameter of the pipe about which the packers 70 are intended to seal. Additionally, in other embodiments, the rams 34 could be provided as variable-bore pipe rams used to seal around pipes within a range of diameters. Each ram 34 is also shown as including a slot 76 for receiving a portion (e.g., a button) of a connecting rod controlled by an actuator 36 for moving the ram 34 into and out of the bore 42 of the frac stack body 40.

Rams 34 in the frac stack body 40 may also or instead be provided as blind rams, such as those depicted in FIG. 6. In this example, the blind rams 34 include ram blocks 66, top seals 68, and ram packers 70. Unlike the packers 70 of the pipe rams in FIG. 5, however, the packers 70 in FIG. 6 do not include recesses 78 for receiving a pipe. Consequently, when installed in a frac stack body 40, the pair of blind rams 34 may close against one another along sealing surfaces 74 to seal the bore 42 and prevent flow through the frac stack 32. The ram packers 70 of FIG. 6 include alignment pins 72 similar or identical to those of FIG. 5. And like the pipe rams of FIG. 5, the blind rams shown in FIG. 6 include slots 76 for receiving connecting rods to enable control of the rams by actuators 36. Although the rams 34 depicted in FIGS. 5 and 6 are oval rams, in other instances the rams 34 could be round rams having a circular cross-section. Further, opposing rams 34 in the body 40 could instead be provided in other forms, such as gate-style rams that slide over one another or shear rams.

The actuators 36 can be hydraulic actuators with operating cylinders that are coupled to the frac stack body 40 and include operating pistons that control the position of the rams via connecting rods. In some other embodiments, the actuators 36 are electric actuators, which may include electric motors that control a drive stem for moving the rams. The actuators 36 can be attached to the frac stack body 40 in any suitable manner, such as with bonnets fastened to the frac stack body 40 with bolts, hydraulic tensioners, or clamps.

Figure 7:
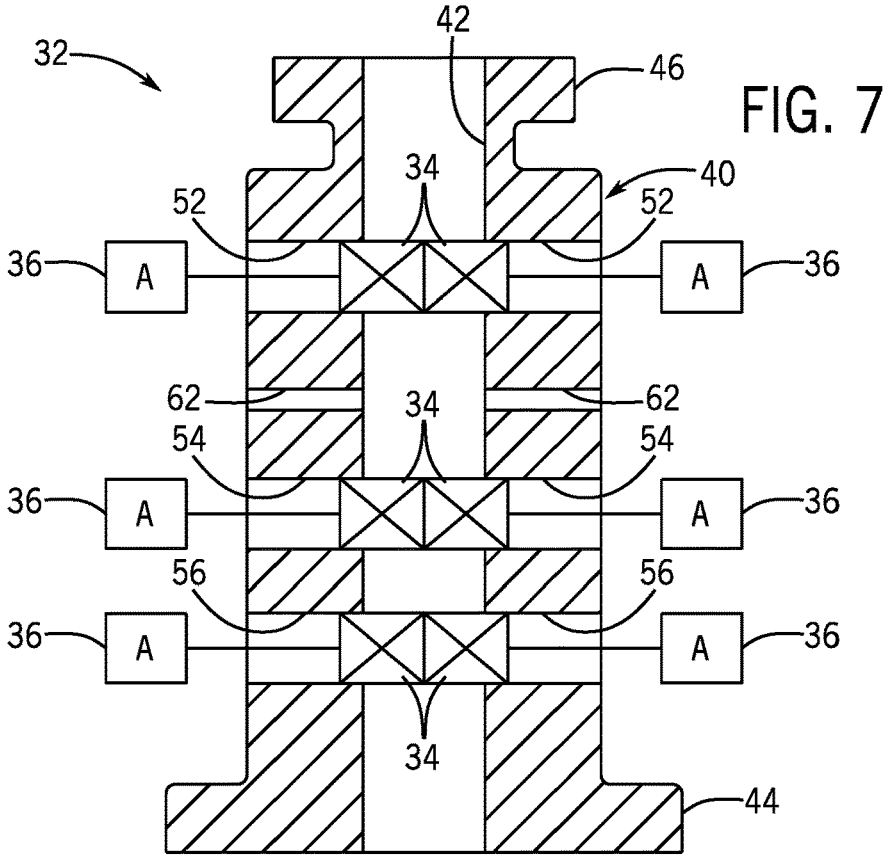
FIGS. 7 and 8 schematically depict closing of rams within the frac stack body of FIG. 4 in accordance with some embodiments.

As noted above, the rams 34 can be used to control flow through the frac stack body 40. As generally shown in FIG. 7, for example, each of the ram cavity pairs 52, 54, and 56 includes a pair of opposing rams 34 (e.g., blind rams) that are closed to seal against one another and prevent flow through the bore 42. The rams 34 in the cavities 52, 54, and 56 may be selectively retracted (i.e., opened) to allow fluid to flow through the bore 42. For instance, all of the rams 34 in FIG. 7 can be retracted to allow fracturing fluid to flow through the bore 42 from the upper end of the frac stack body 40 (such as from the goat head 26) to the lower end of the body 40, from which the fracturing fluid may flow into the wellhead 14 and then down into the well 12.

Figure 8:
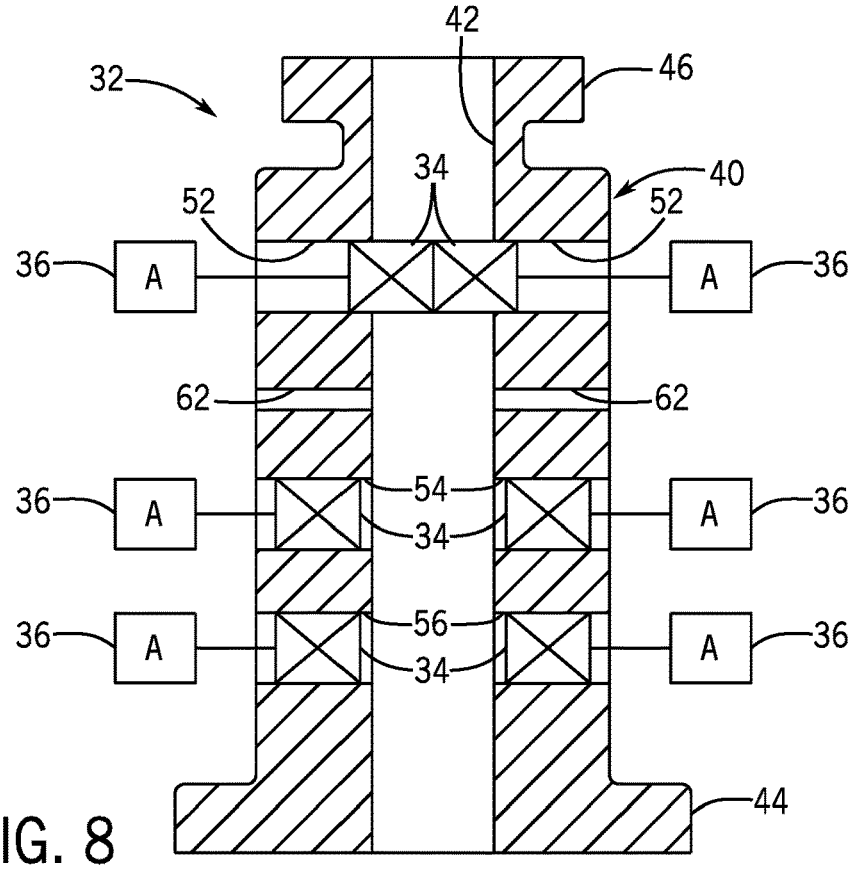

In other cases, some of the rams 34 in the frac stack body 40 are opened while other rams 34 in the body 40 remain closed. For example, the rams 34 in the ram cavities 52 may be closed while the rams 34 in the ram cavities 54 and 56 are open, as generally illustrated in FIG. 8. This allows fluid to pass between the conduits 62 and a lower portion of the bore 42, while the rams 34 of the ram cavities 52 isolate the lower portion of the bore 42 from an upper portion of the bore. In this arrangement, pumpdown fluid may be pumped through a conduit 62 into the bore 42 and then down into a well 12 while preventing flow of the pumpdown fluid out of the upper end of the frac stack 32. Similarly, flowback fluid coming up through the well 12 can be routed out of the frac stack body 40 through a conduit 62, with the closed rams 34 of the ram cavities 52 preventing flowback fluid from flowing out of the upper end of the frac stack 32.

Figure 9:
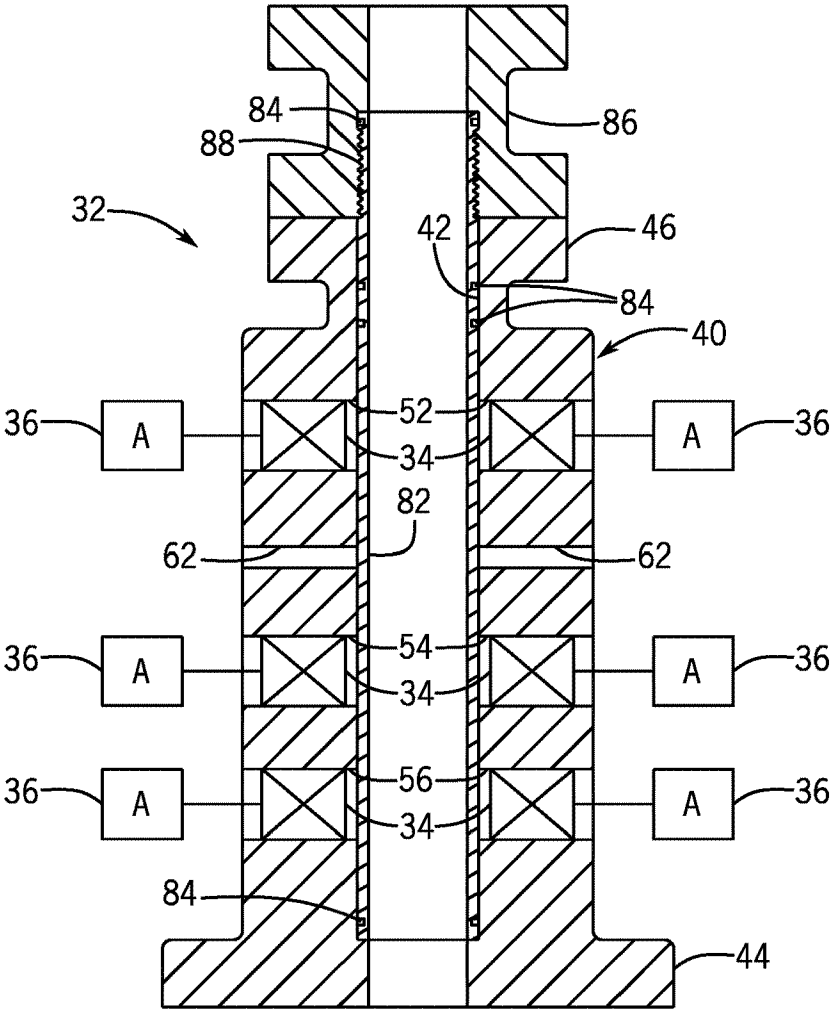

Fracturing fluid typically contains sand or other abrasive particulates that can erode components exposed to the fluid. In some embodiments, a protective sleeve is provided within the frac stack body 40 to isolate the rams 34 and their seals from erosive flow. One example of this is depicted in FIG. 9, which shows a protective sleeve 82 positioned in the bore 42 of the frac stack body 40. As shown, the protective sleeve 82 is landed on an internal shoulder within the frac stack body 40 and has an inner diameter equal to that of the bore 42 below the protective sleeve 82 at the internal shoulder. Seals 84 act as pressure barriers between the protective sleeve 82 and the wall of the bore 42 to prevent fracturing fluid from flowing along the outside of the sleeve 82 to the rams 34.

Figure 10:
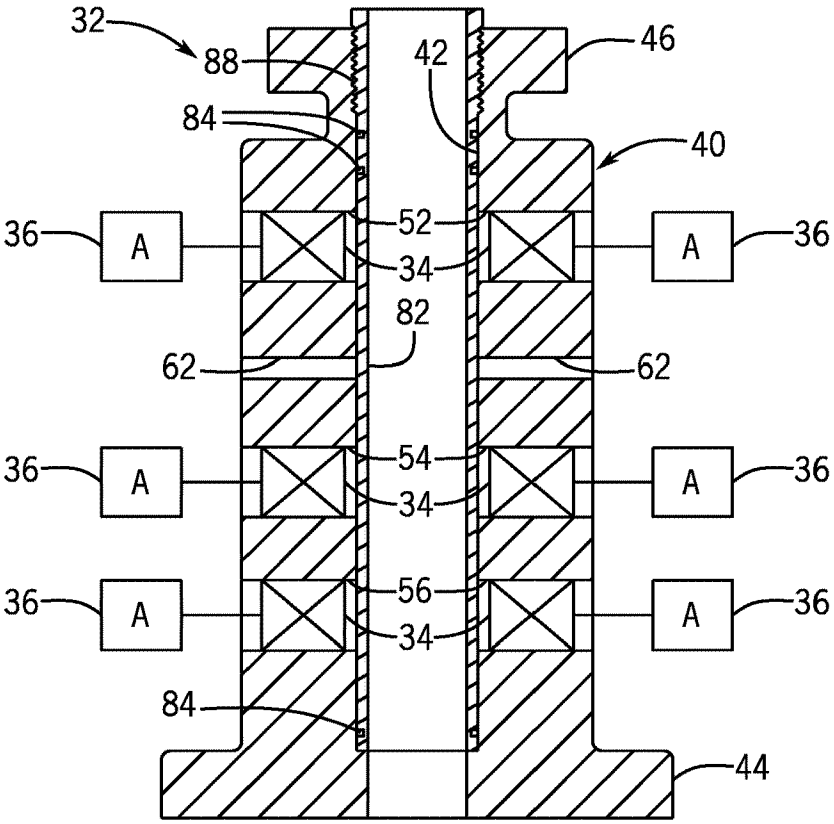
FIGS. 9 and 10 generally depict protective sleeves disposed in frac stack bodies to shield rams from erosive flow in accordance with some embodiments.

In some embodiments, the protective sleeve 82 is installed in the frac stack body 40 with an adapter component. In FIG. 9, for example, the protective sleeve 82 is connected via a threaded interface 88 to an adapter spool 86, which is fastened to the upper flange 46 of the frac stack body 40. But in other embodiments, the protective sleeve 82 is installed in the bore 42 without an adapter. One such embodiment is depicted in FIG. 10, in which the protective sleeve 82 is threaded instead to the upper end of the frac stack body 40. Although the top of the protective sleeve 82 is shown protruding from the frac stack body 40, the entire sleeve 82 could be received within the body 40 in other instances.

Figure 11:
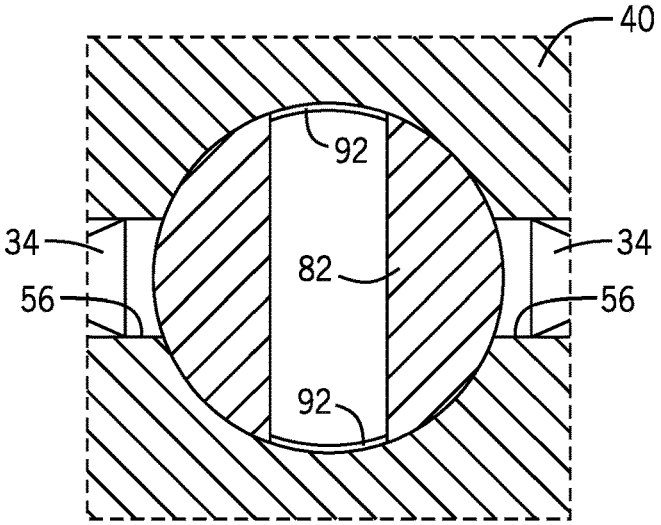
FIGS. 11-13 depict a protective sleeve that can be rotated to selectively shield rams in a frac stack body in accordance with one embodiment.
Figure 12:
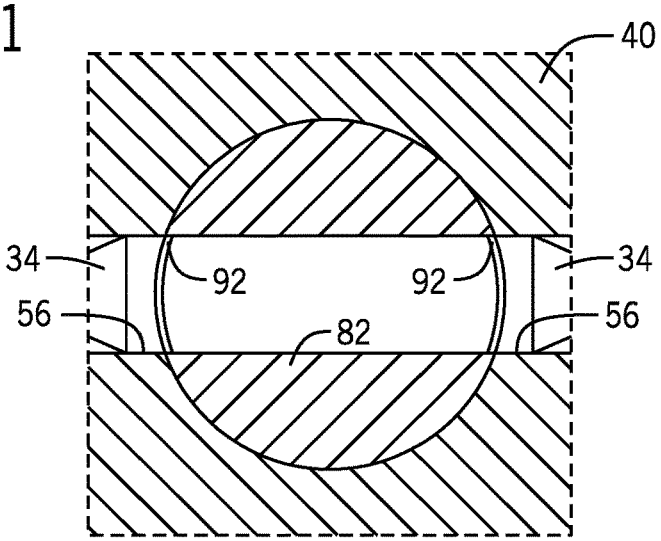
Figure 13:
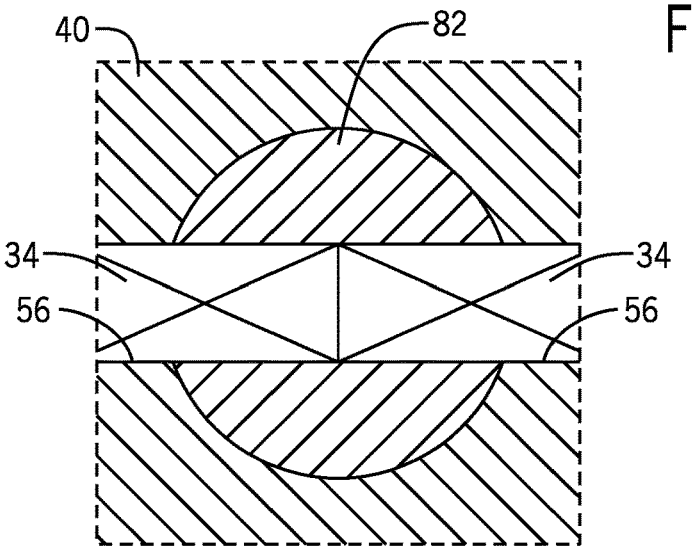

The protective sleeve 82 can be moved within the bore 42 of the frac stack body 40 to selectively cover ram cavities and protect installed rams 34. By way of example, a protective sleeve 82 with apertures 92 is depicted in FIGS. 11-13. With the sleeve 82 positioned as shown in FIG. 11, the apertures 92 are circumferentially offset from the ram cavities 56 and the side walls of the sleeve 82 shield rams 34 in the cavities 56 from erosive flow (e.g., of fracturing fluid) through the sleeve 82. Flow through the sleeve 82 (and, thus, the frac stack body 40) can be prevented by rotating the sleeve 82 to align the apertures 92 with the ram cavities 56 and then closing the rams 34 together through the apertures 92 to seal the bore, as generally shown in FIGS. 12 and 13. The rams 34 can later be opened and withdrawn out of the apertures 92 to allow flow, and the sleeve 82 can be rotated to again cover the ram cavities 56. In other embodiments, the protective sleeve 82 can be raised or lowered within the bore 42 to move the apertures 92 axially to selectively cover the ram cavities 56. Although ram cavities 56 are depicted in FIGS. 11-13, it will be appreciated that these same techniques and others described below could also or instead be used with other ram cavities, such as ram cavities 52 or 54.

Figure 16:
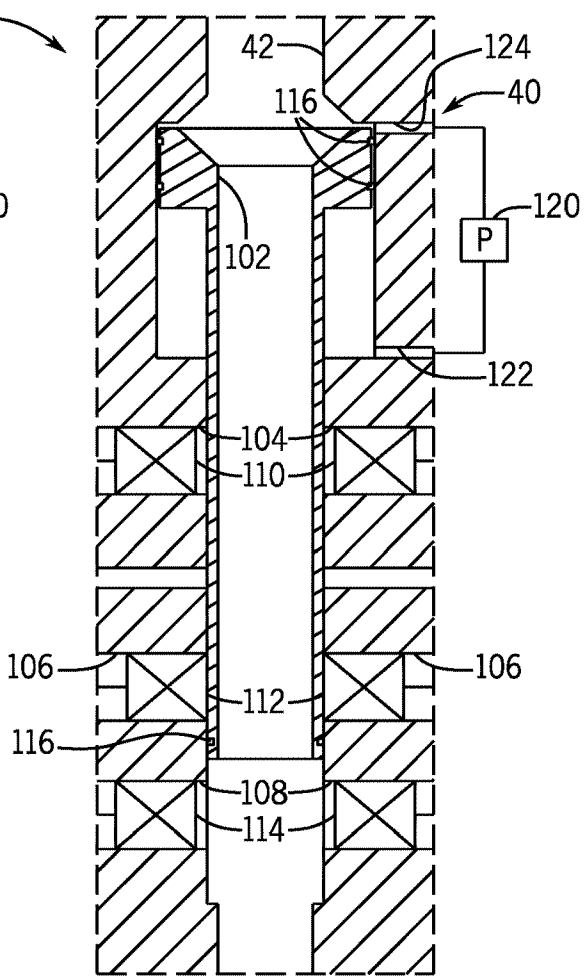
FIGS. 14-16 depict a protective sleeve that can be moved axially within a bore of a frac stack body to selectively uncover a pair of rams to facilitate flow control within the frac stack body in accordance with one embodiment.
Figure 15:
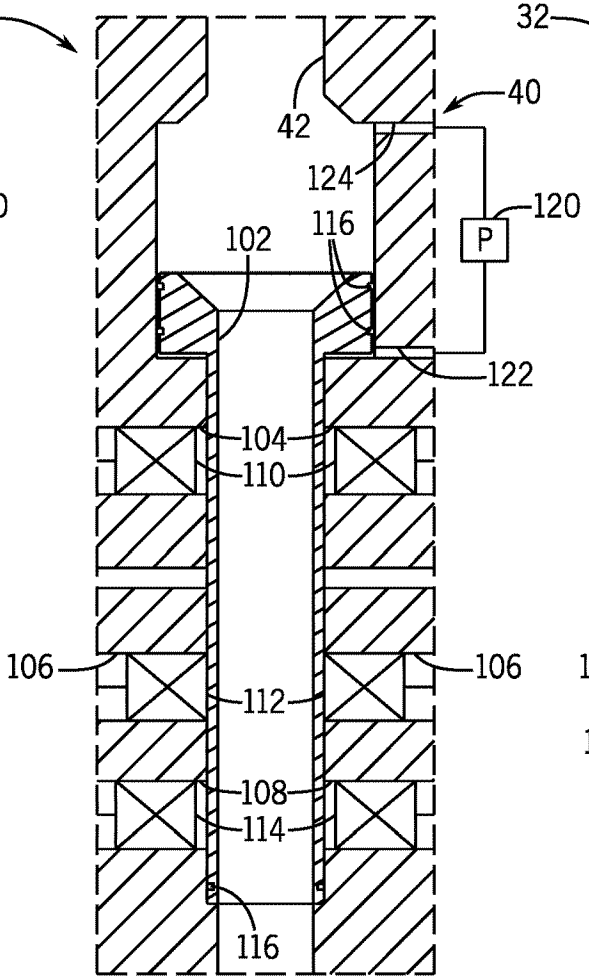
Figure 14:
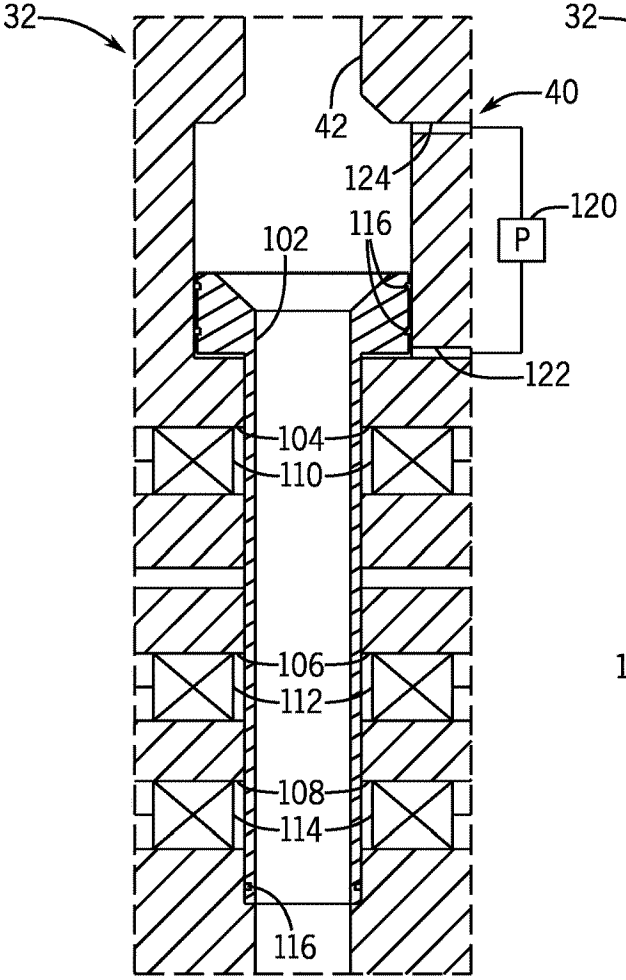

Another example of a frac stack 32 having a protective sleeve is generally depicted in FIGS. 14-16. In this embodiment, the protective sleeve 102 is disposed within the bore 42 to cover ram cavities 104, 106, and 108 and shield installed rams 110, 112, and 114 from erosive flow. The assembly includes seals 116 between the exterior of the sleeve 102 and the frac stack body 40. The seals 116 include lip seals in some embodiments, but the seals 116 (and the seals 84 above) can be provided in any suitable form. Because of the seals and the shape of the protective sleeve 102, pressurized fluid within the bore 42 applies a differential pressure on the sleeve 102 and biases the sleeve down into the position depicted in FIG. 14.

The protective sleeve 102 is shown in FIG. 14 as covering each of the ram cavities 104, 106, and 108. Although other rams may instead be used in the ram cavities, in at least some embodiments the rams 110 are shear rams, the rams 112 are pipe rams, and the rams 114 are blind rams. The protective sleeve 102 can be axially displaced to uncover the ram cavities 108 and allow the rams 114 to close and seal the bore 42.

In at least some embodiments, the protective sleeve 102 is hydraulically actuated. For example, as shown in FIGS. 14-16, the upper end of the protective sleeve 102 operates as a piston head to facilitate hydraulic actuation of the sleeve 102. More particularly, the sleeve 102 can be raised by routing fluid (such as with a pump 120) through conduit 122 into the bore 42 to lift the sleeve 102. In at least one embodiment, fluid within the bore 42 is used as the control fluid for actuating the protective sleeve 102. Fracturing fluid within the bore 42 can be diverted out from the bore 42 through conduit 124 and then be pumped with pump 120 or otherwise routed back into the bore through the conduit 122 to raise the protective sleeve 102, for instance. In at least some cases, the pipe rams 112 are closed to seal about the exterior of the sleeve 102 (as shown in FIG. 15) and fluid is then routed through the conduit 122 into the bore 42—more specifically, into an enclosed volume that is outside the sleeve 102 and partially bound by the pipe rams 112—to lift the sleeve 102 and expose ram cavities 108 (as shown in FIG. 16). The protective sleeve 102 can be lifted in different ways in other embodiments, such as with an electric motor or with an external hydraulic sleeve or cylinder. Once the sleeve 102 is lifted, the blind rams 114 may be closed to seal the bore 42 and prevent flow through the bore 42 of frac stack body 40. In an emergency, such as in the case of excessive flowback, shear rams 110 can be closed to shear the protective sleeve 102 and close the bore 42.

Figure 17:
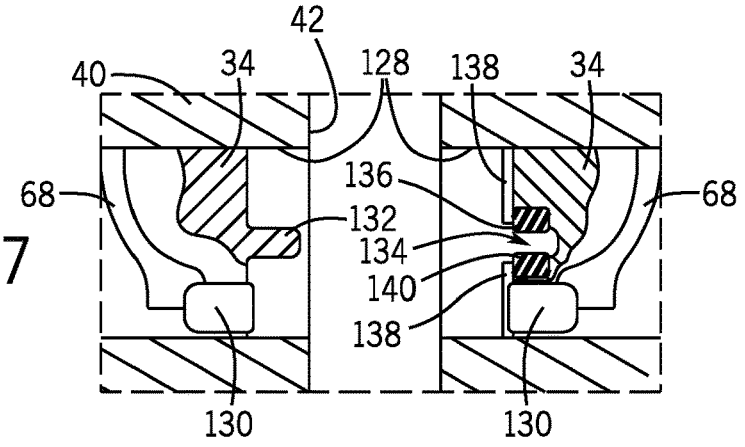
FIGS. 17-26 depict sealing configurations of rams that can be used in a fracturing tree in accordance with certain embodiments.
Figure 18:
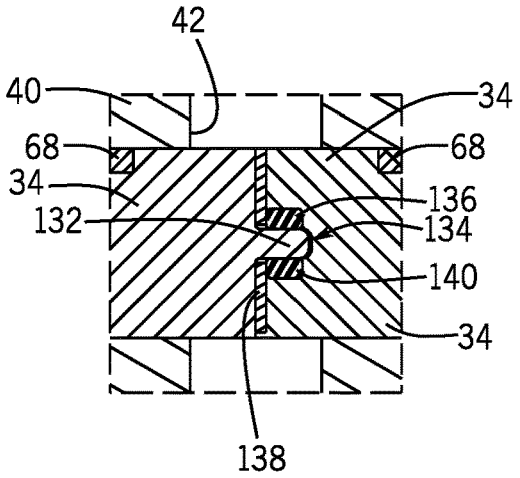

The rams of the frac stack 32 can be designed with features to reduce erosive wear on sealing elements and increase service life. One example is generally depicted in FIGS. 17 and 18, which show rams 34 disposed in opposing ram cavities 128 of a frac stack body 40. These rams 34 include top seals 68 and side packers 130 that seal against the frac stack body 40. But rather than having packers that extend across opposing front faces of the rams and seal against one another along those front faces when the rams are closed, the depicted rams 34 include a protruding ridge or nose 132 that is received in a slot 134 when the rams 34 are closed (FIG. 18).

Seals 136 and 140 (which may also be referred to as nose packers) within the slot 134 seal against the nose 132. When the rams 34 are closed, the seals 136 and 140 cooperate with the top seals 68 and the side packers 130 to prevent flow through the bore 42. Because the surfaces of the seals 136 and 140 that contact the nose 132 are positioned within the slot 134 transverse to the flow direction through the bore 42, erosive wear on these surfaces may be lower than in the case of front-facing packers (e.g., packers 70) exposed to abrasive flow generally parallel to their sealing faces. Although upper and lower nose packers 136 and 140 are depicted in FIGS. 17 and 18, either of these could be omitted and a single nose packer could be used in other embodiments. In at least some instances, plates 138 can be positioned along the front face of the ram 34 that has the nose packers 136 and 140 to retain or protect the packers 136 and 140. The plates 138 can be fastened to the ram block or attached in any other suitable manner.

Figure 19:
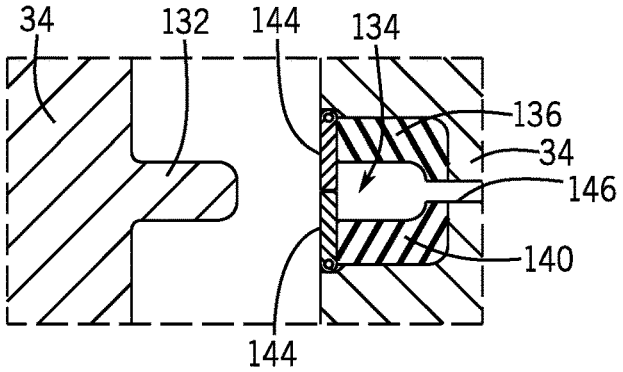
Figure 20:
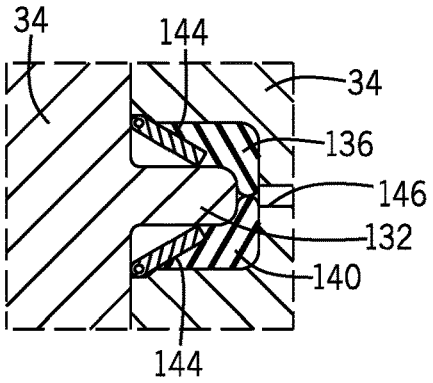

In another embodiment generally depicted in FIGS. 19 and 20, protective doors or blades 144 protect the nose packers 136 and 140. These blades 144 are displaced by the nose 132 during closing of the rams 34 against one another, with the nose packers 136 and 140 sealing against the nose 132 within the slot 134, as described above. As also shown in FIGS. 19 and 20, the ram 34 having the slot 134 can also include a weep hole 146 to allow fluid within the slot 134 to drain from the slot when displaced by the nose 132 during closing of the rams.

Figure 21:
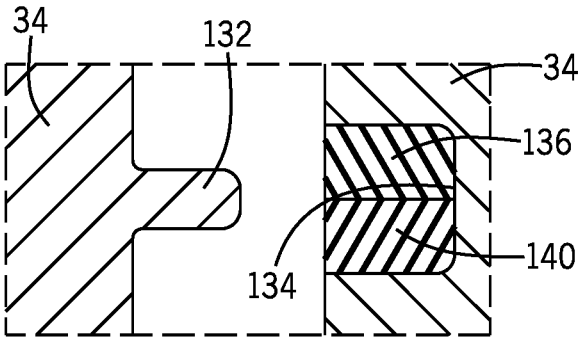
Figure 22:
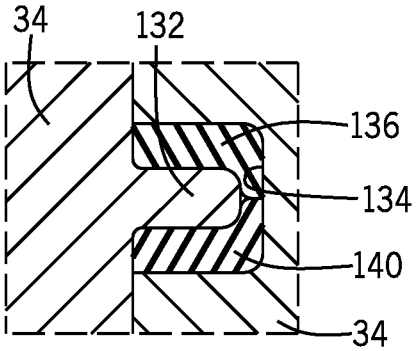

In FIGS. 17-20 above, the nose packers 136 and 140 are shown recessed from the front face of the ram. That is, the nose packers 136 and 140 in those figures are not provided at the leading edges of the rams 34. In other embodiments, the plates 138 and blades 144 are omitted and the nose packers 136 and 140 are positioned along the front face of the ram, such as depicted in FIGS. 21 and 22. In this example, the nose packers 136 and 140 press against one another when the rams 34 are open (FIG. 21), which may reduce abrasive wear on the surfaces of the nose packers 136 and 140 that seal against the nose 132 when the rams 34 are closed (FIG. 22).

Figure 23:
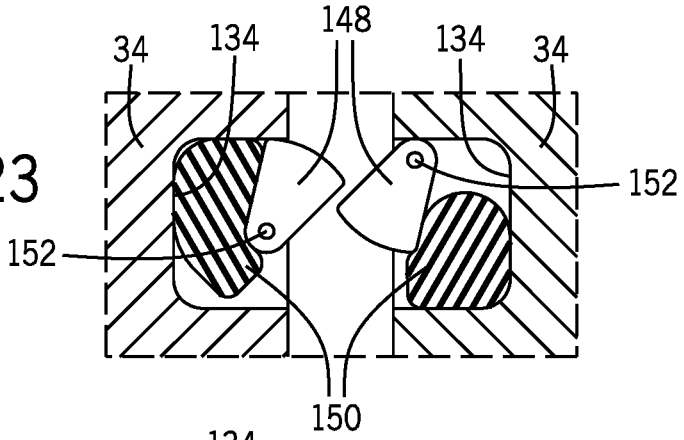
Figure 24:
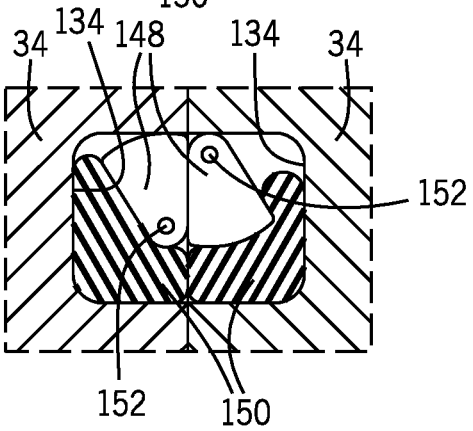

In yet another embodiment shown generally in FIGS. 23 and 24, the rams 34 include levers 148 (e.g., metal levers) that are positioned in front of seals 150 in slots 134 to protect those seals during fracturing. As depicted, the levers 148 contact each other and rotate about pins 152 when the rams close against one another. The rotating levers 148 push the seals 150 into sealing engagement with each other to close the bore and prevent flow.

Figure 25:
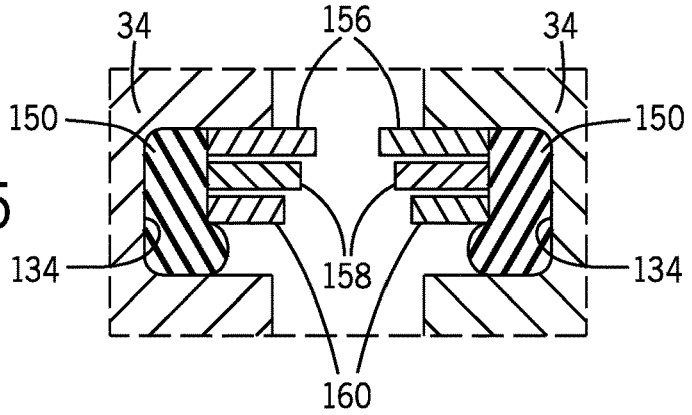
Figure 26:
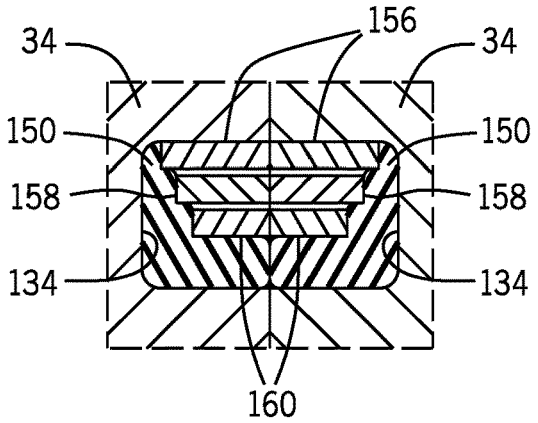

In a still further embodiment shown generally in FIGS. 25 and 26, the rams 34 include seals 150 in slots 134, along with metal plates 156, 158, and 160. These metal plates 156, 158, and 160 protect the seals 150 during fracturing and drive the seals 150 toward each other upon closing the rams 34. More specifically, as the rams 34 close, the metal plates 156 of the two rams engage one another and are pushed back into their respective slots 134 as the rams continue to close. This is followed by the metal plates 158 engaging one another and being pushed back into their slots 134, and then the metal plates 160 engaging one other and being pushed back into the slots 134, as the rams close. As the plates 156, 158, and 160 move back into the slots 134, they displace the seals 150 and drive the seals into sealing engagement with one another. While the plates 156, 158, and 160 are positioned in FIGS. 25 and 26 to generally drive the seals 150 below the plates, this could be reversed and the plates could drive the seals 150 above the plates (e.g., by flipping the rams 34). The metal plates 156, 158, and 160 can be connected within the ram 34 in any suitable manner. For example, the plates can be received in slots in the ram blocks or adhered to the seals 150. In certain embodiments, the plates 156, 158, and 160 are connected together, such as with mating pins and slots that allow the plates to slide relative to one another.

Figure 27:
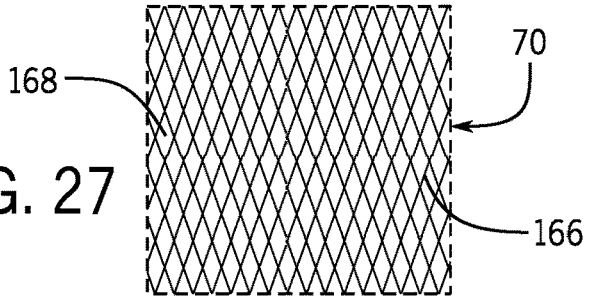
FIG. 27 depicts a portion of a ram packer or other seal having a wire mesh for reducing erosive wear of a body of the ram packer or other seal in accordance with one embodiment.

The packers and other seals described above can be formed of any suitable materials, and in at least some embodiments include elastomer. Some ram packers or seals can include a wire mesh to reduce erosive wear. For example, as depicted in FIG. 27, a ram packer 70 (or some other ram seal) includes a wire mesh 166 on an elastomer body 168. In some embodiments, the wire mesh 166 is partially embedded in the elastomer body 168, such as in a sealing face of the packer 70. The wire mesh 166 may reduce wear of the elastomer body 168 when placed in erosive service, such as within the frac stack body 40.

Figure 28:
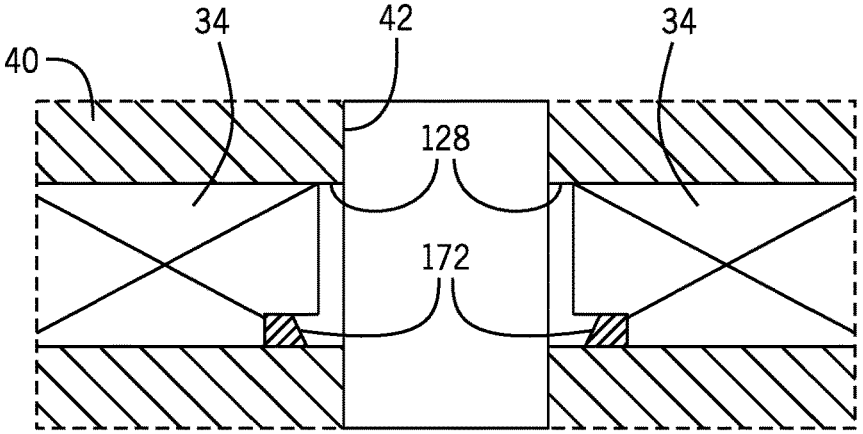
FIG. 28 depicts rams with wipers for pushing sand out of ram cavities and into a bore of a frac stack body in accordance with one embodiment.

Still further, in at least some embodiments the frac stack 32 includes features to reduce collection of sand or other particulates from the fracturing fluid within the frac stack body 40. By way of example, rams 34 in the frac stack body 40 can include blades or rubber wiper seals 172, as generally depicted in FIG. 28. As the rams 34 close, the blades or wiper seals 172 displace sand or other particulates that have settled on surfaces of the ram cavities 128. And in at least some embodiments, seals (e.g., lip seals) can be provided about the exterior of the rams 34 to seal against the surfaces of the ram cavities 128 and prevent fracturing fluid from flowing past the rams 34 from the bore 42 and depositing sand (or other particulates) behind the rams 34.

Intervention tools may be run into wells to perform various functions. Such intervention tools can include perforating guns, setting tools (e.g., for plugs or seals), evaluation tools (e.g., logging tools, testing tools, sampling tools, or inspection tools), or cleanup tools, to name several examples. An intervention tool may be lowered into a well on a line, such as a wireline, a slickline, a braided line, or a coiled tubing line. Such lines may be reeled from a spool; in these cases, the lines and associated deployment equipment (e.g., spools, control units, sheaves, and motors) may be referred to as spool conveyance systems. The intervention tools, which may also be referred to as downhole tools, can be employed alone or in combination with other tools in a tool string lowered together into a well on a line.

Figure 29:
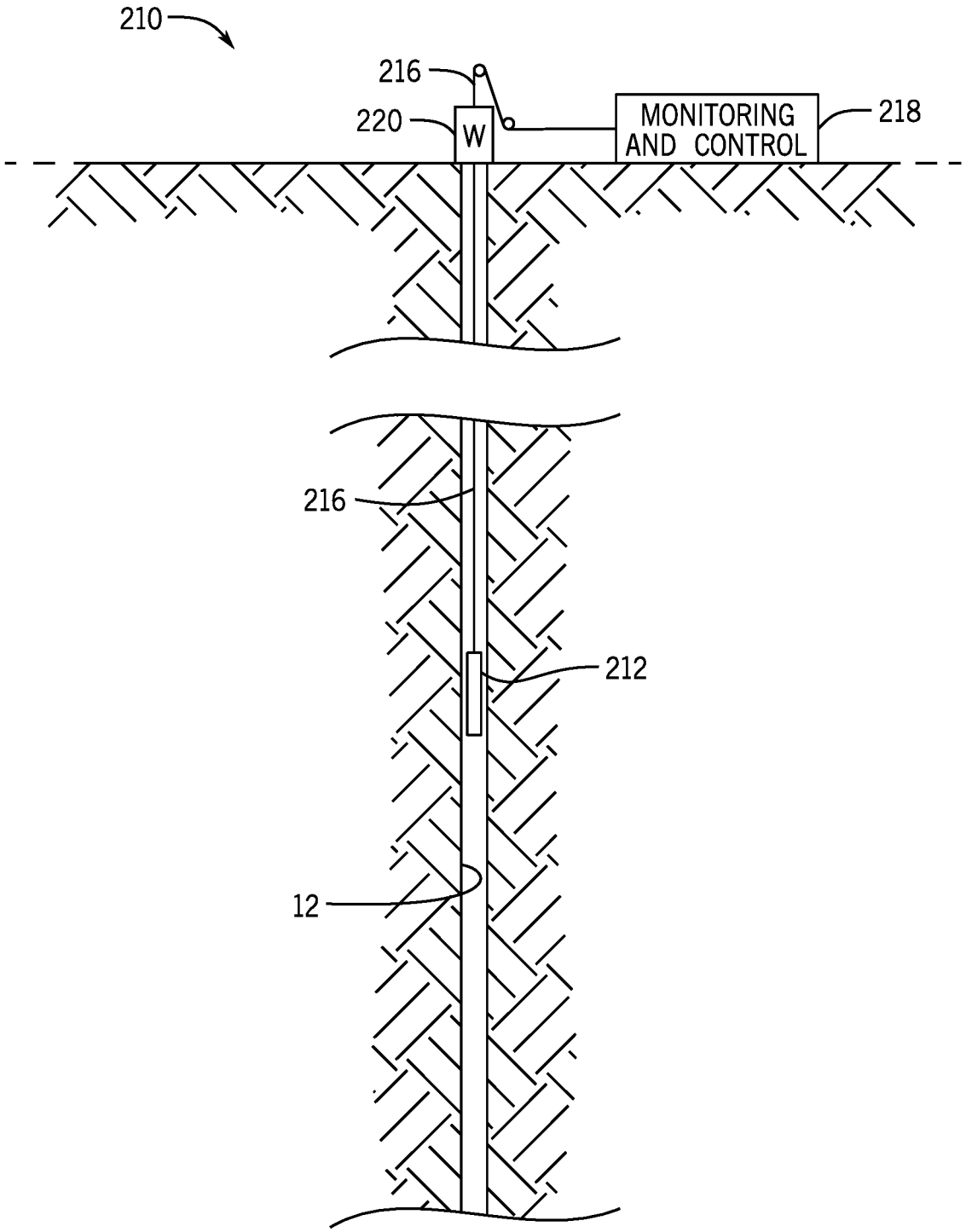
FIG. 29 generally depicts an apparatus including a downhole tool deployed within a well on a cable lowered through a wellhead assembly in accordance with one embodiment.

A well intervention apparatus 210 is depicted in FIG. 29 in accordance with one embodiment. In this depicted embodiment, an intervention tool 212 is suspended in a well 12 on a line 216. The intervention tool 212 could be deployed in the well 12 as a single tool or as multiple tools coupled together in a tool string. In some instances, the intervention tool 212 includes a perforating gun, a plug setting tool, an evaluation tool, or a cleanup tool. Further, the line 216 in some instances is a wireline cable, which may include at least one conductor that enables data transmission between the intervention tool 212 and a monitoring and control system 218. But any suitable line 216 may be used, such as a slickline, a non-conducting braided line, or a coiled tubing line.

The intervention tool 212 may be raised and lowered within the well 12 via the line 216 in any suitable manner. For instance, the line 216 can be reeled from a drum in a service truck, which may be a logging truck having the monitoring and control system 218. While the apparatus 210 is shown in FIG. 29 at an onshore well 12, the apparatus 210 could be used with an offshore well in full accordance with the present techniques.

In some embodiments, the monitoring and control system 218 controls movement of the intervention tool 212 within the well 12 and receives data from the intervention tool 212. In one embodiment, the intervention tool 212 includes a perforating gun and the monitoring and control system 218 sends signals for operating the perforating gun to the intervention tool 212. The monitoring and control system 218 can include one or more computer systems or devices. The system 218 can receive data from the intervention tool 212, and this data can be stored, communicated to an operator, or processed. Although generally depicted in FIG. 29 at a wellsite, it is noted that the system 218 could be positioned elsewhere, and that the system 218 could be a distributed system with elements provided at different places near or remote from the well 12. For example, a local component of the system 218 may be located at the wellsite for controlling operation of the intervention tool 212 and receiving data from the tool 212, but the received data could be processed by a different portion of the system 218 at another location.

The intervention tool 212 can be lowered via the line 216 into the well 12 through a wellhead assembly 220. In some fracturing systems, an intervention tool would be run into a well by connecting a pressure-control string, including a lubricator and a blowout preventer (e.g., a coiled tubing blowout preventer or a wireline blowout preventer, which is also known as a wireline valve), to the top of a fracturing tree. The intervention tool could then be lowered from the lubricator on a line into the well through the pressure-control string blowout preventer, which could be used to seal around the line. But in at least some embodiments of the present technique, the wellhead assembly 220 includes a frac stack having rams for opening and closing a bore and a lubricator to facilitate deployment of the intervention tool 212 into the well 12. The well intervention tool may be run into the well 12 from a lubricator and through the frac stack. Moreover, in some embodiments the wellhead assembly 220 does not include a blowout preventer between the frac stack and the lubricator. That is, rather than having a blowout preventer of a pressure-control string attached above the frac stack, one or more rams of the frac stack may be used to seal around the line 216 during well intervention.

Figure 30:
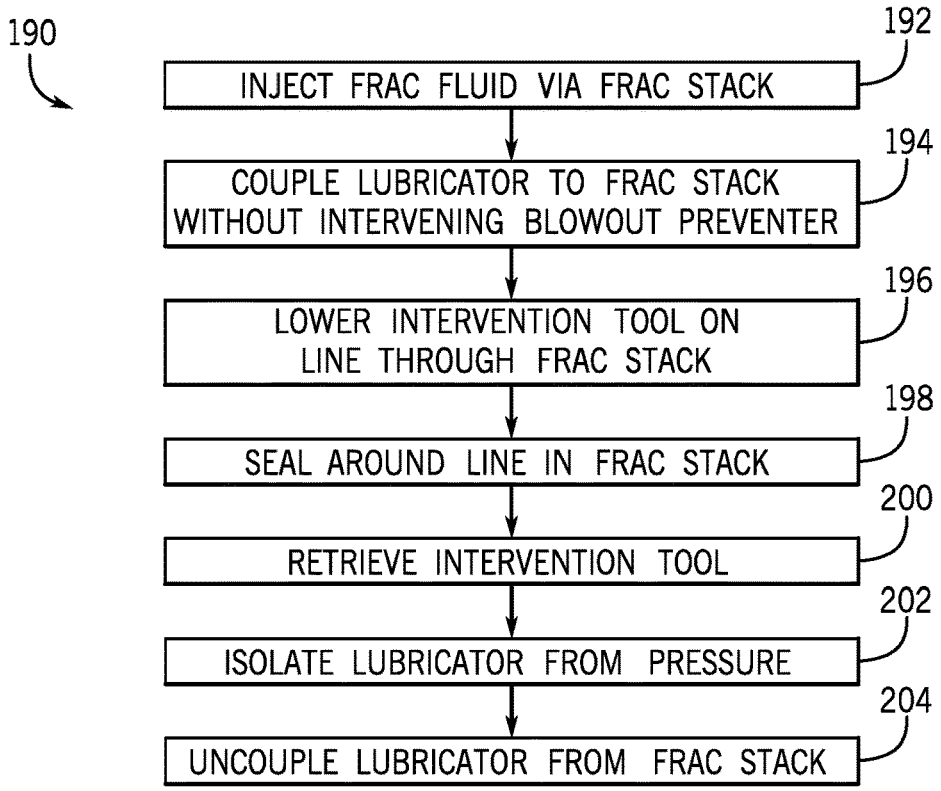
FIG. 30 is a flowchart generally representing a well intervention process in accordance with one embodiment.

In FIG. 30, an example of a well intervention process is generally represented by flowchart 190. In this embodiment, fracturing fluid is injected into a well through a bore of a frac stack coupled to a wellhead (block 192) and a lubricator is coupled to the frac stack without a blowout preventer between the lubricator and the frac stack (block 194). Although generally shown following the injection of frac fluid in FIG. 30, it will be appreciated that the lubricator may be coupled to the frac stack before or after fracturing fluid is injected into the well. An intervention tool (e.g., a tool 212) can be lowered (e.g., via line 216) from the lubricator through the bore of the frac stack and into the well (block 196). In some embodiments, the intervention tool facilitates fracturing operations, such as by perforating a downhole casing or setting an isolation plug.

With the tool lowered into the well on a line, the frac stack can seal around the line (block 198), such as by closing at least one ram to effect a seal about the line and block flow through the bore of the frac stack. In at least some cases, rams of the frac stack are usable as a secondary pressure barrier during tool deployment and the tool may be run into the well and retrieved without closing the rams if pressure is otherwise sufficiently contained. The intervention tool may be retrieved from the well (block 200) and drawn back into the lubricator. The lubricator can then be isolated (block 202) from well pressure (e.g., by closing rams within the frac stack or a swab valve) and uncoupled from the frac stack (block 204). Additional operations could be performed through the frac stack, with the lubricator isolated from well pressure, before disconnecting the lubricator. In some instances, the disconnected lubricator is coupled to an additional frac stack coupled to a wellhead of an additional well to facilitate running of the intervention tool (or a different intervention tool) into the additional well through the additional frac stack. The lubricator can be coupled to the additional frac stack without a blowout preventer between the lubricator and the additional frac stack, and the additional frac stack can include at least one ram that can be closed to effect a seal about a line (e.g., a line 216) suspending the intervention tool in the additional well.

Figure 31:
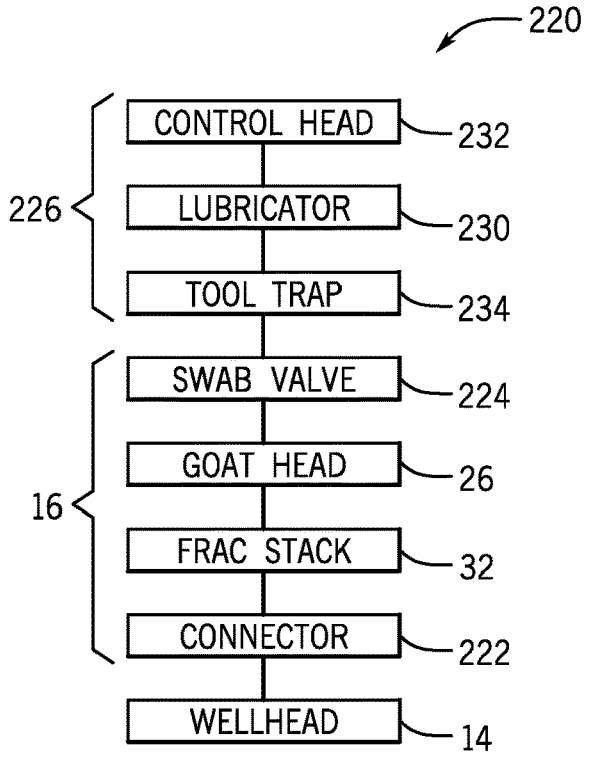
FIG. 31 is a block diagram depicting the wellhead assembly of the apparatus of FIG. 29 in accordance with one embodiment.

Various components of a wellhead assembly 220 having an equipment stack installed on a wellhead 14 are depicted in FIG. 31 in accordance with one embodiment. The depicted equipment includes a fracturing tree 16 mounted over the wellhead 14, with the fracturing tree 16 including a frac stack 32 having rams and a connector 222 for coupling the fracturing tree 16 to the wellhead 14. The connector 222 could have a studded or bolted connection, but in at least some cases the connector 222 includes a quick-connect device (e.g., with a threaded or hydraulically set connection) to facilitate efficient connection of the fracturing tree 16 to the wellhead 14. The depicted fracturing tree 16 also includes a goat head 26 and a swab valve 224. The swab valve is shown in FIG. 31 positioned above the goat head 26, but the swab valve 224 may instead be positioned below the goat head 26.

The equipment of the wellhead assembly 220 in FIG. 30 also includes a lubricator assembly 226 positioned above the fracturing tree 16. The depicted lubricator assembly 226 includes a lubricator 230, a control head 232 (which in some instances may be a grease head), and a tool trap 234. As will be appreciated, the lubricator 230 can include one or more pipes for receiving the tool 212 and facilitating running of the tool 212 into and out of the well 12, the control head 232 seals around the line 216 above the lubricator 230, and the tool trap 234 below the lubricator 230 can catch the tool 212 if it is disconnected from the line 216 while in the lubricator 230. The lubricator assembly 226 may also or instead include other components, such as a stuffing box, a line cutter, and a sheave for running the line 216 into the wellhead assembly 220. The components of the fracturing tree 16 and the lubricator assembly 226 can be connected to each other in any suitable manner. The lubricator assembly 226 can include a connector (e.g., a quick connect) for coupling the lubricator assembly 226 to the fracturing tree 16 directly or via one or more additional components. But in at least some embodiments of the present technique, rather than having a pressure-control string with a lubricator and a blowout preventer connected to a fracturing tree, the lubricator assembly 226 does not include a blowout preventer and the lubricator 230 is coupled to the fracturing tree 16 without an intervening blowout preventer for sealing about the line 216.

Figure 33:
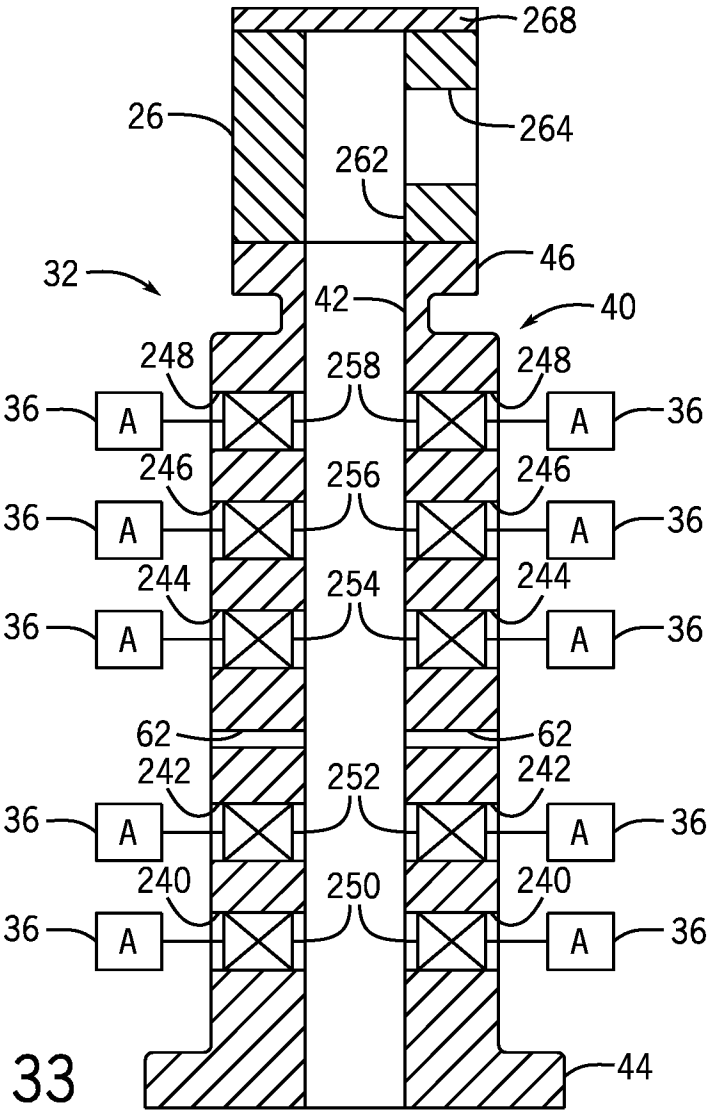
FIGS. 32 and 33 are schematic representations of a frac stack having a bore and rams for controlling flow through the bore in accordance with one embodiment.
Figure 32:
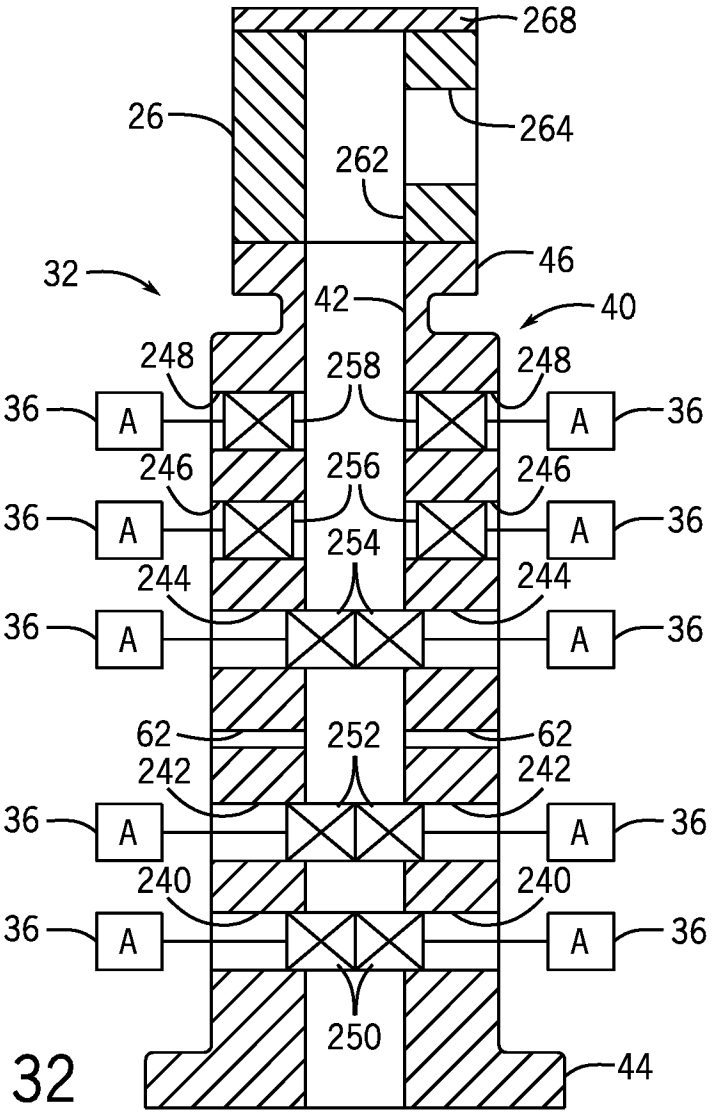

Some embodiments of fracturing trees including rams for sealing about the line 216 are generally depicted in FIGS. 32-39. In FIGS. 32 and 33, for instance, the body 40 of the frac stack 32 includes various rams that can be opened or closed to control flow through the bore 42. More specifically, this depicted ram assembly includes the body 40 having ram cavities 240, 242, 244, 246, and 248 with rams 250, 252, 254, 256, and 258. The body 40 in which the rams are housed can be a unitary body or a multi-piece body. In one embodiment, the body 40 includes multiple housings in which at least one of the rams is installed. Each of the rams 250, 252, 254, 256, and 258 may be any of various types (e.g., blind rams, pipe rams, shear rams, or wireline rams) and shapes (e.g., oval rams, round rams, or rectangular rams) and, collectively, this group of rams may include combinations of such types and shapes. Although the rams are shown in opposing pairs in FIGS. 32 and 33, in other instances one or more pairs of these rams may be replaced by a single ram. In one embodiment, for example, a single ram 250, a single ram 252, and a single ram 254 are used to close the bore 42 in place of the depicted pairs of rams 250, 252, and 254. In such an embodiment, the body 40 may include single ram cavities 240, 242, and 244, rather than pairs of such ram cavities.

Figure 34:
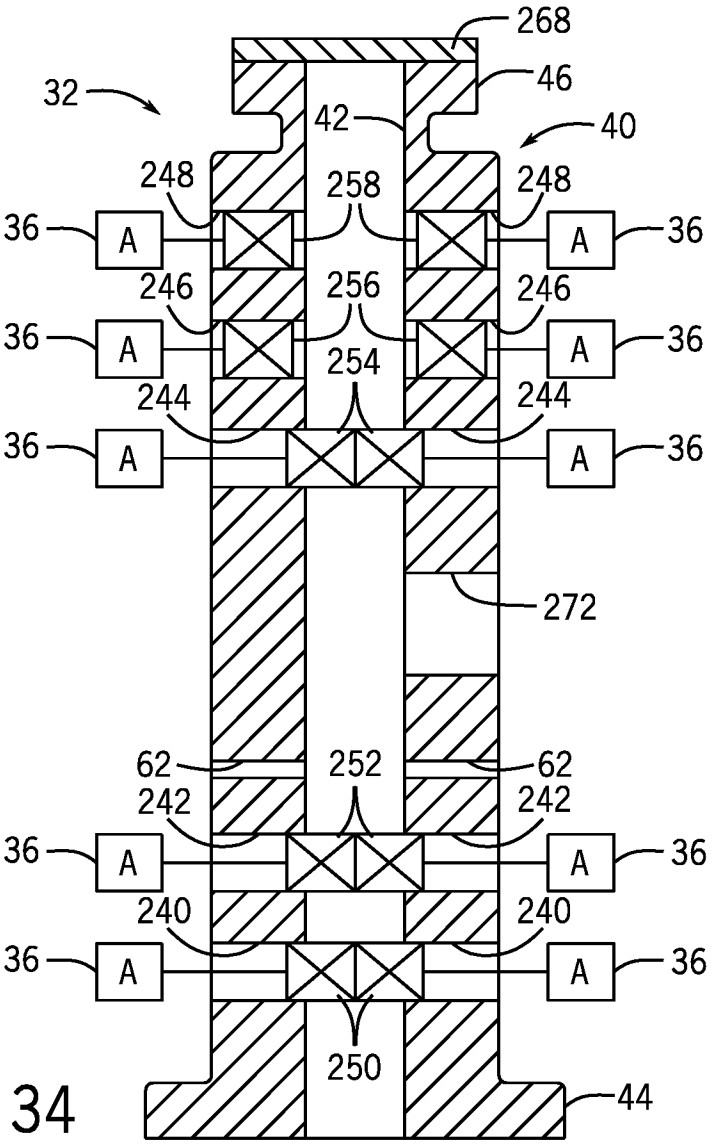
FIG. 34 schematically depicts the frac stack of FIGS. 32 and 33 without a separate goat head in accordance with one embodiment.

As shown in FIGS. 32 and 33, a goat head 26 with a bore 262 is coupled to the body 40. Fracturing fluid can enter the goat head 26 through one or more inlets 264 and pass into the bore 42 of the body 40 via the bore 262 of the goat head 26. A single inlet 264 is depicted in FIGS. 32 and 33, but in other embodiments the goat head 26 can include multiple connections. Further, in some instances multiple goat heads 26 could be used to route fracturing fluid into the bore 42. Although the goat head 26 is shown as a separate component connected above the body 40 in FIGS. 32 and 33, in some embodiments (an example of which is depicted in FIG. 34) the body 40 may also or instead include one or more inlets 272 for receiving fracturing fluid directly into the body 40. In another embodiment, a goat head may be laterally offset from the equipment depicted in FIG. 32, 33, or 34 and connected to route fracturing fluid from the offset goat head into the equipment via one or more of the inlets 264 or 272. A tree cap 268 can be connected above the goat head 26 to seal the upper end of the depicted assembly. Although not shown in FIGS. 32 and 33, it will be appreciated that this equipment may also include a swab valve 224 above the body 40 (e.g., immediately above or below the goat head 26).

As described above, the rams installed in the body 40 can be moved between open and closed positions by actuators 36. In certain embodiments, the rams 250, 252, and 254 are blind rams for sealing an open bore and the rams 256 and 258 are intervention rams for sealing around the line 216 when the intervention tool 212 is lowered into the well 12 through the bore 42. The intervention rams may include pipe rams configured to seal around a tubular line (e.g., coiled tubing) or wireline rams configured to seal around wire or cable (e.g., wireline, slickline, or braided line). The intervention rams in other embodiments may also include shear rams, which may be installed as an additional pair of rams (e.g., between rams 254 and 256 in the body 40) or as some of the rams shown in FIGS. 32 and 33 (e.g., the rams 256 could also or instead be shear rams).

Rams 250, 252, and 254 can be used to control flow of fracturing fluid from the goat head 26 into the well 12 through the bore 42 during a fracturing operation. That is, with intervention rams 256 and 258 retracted to the open position, the rams 250, 252, and 254 can be closed, such as shown in FIG. 32, to block flow through the bore 42 and opened, such as shown in FIG. 33, to allow fracturing fluid to be pumped into the well 12 through the frac stack 32. In some instances, a protective sleeve (e.g., a sleeve like protective sleeve 82 or 102) can be used in the body 40 to protect sealing elements (e.g., elastomer seals) of retracted rams during fracturing. The intervention rams 256 and 258 can remain in the body 40 while fracturing fluid is pumped into the well 12 through the bore 42 or could be installed in the body 40 for tool deployment operations and removed before fracturing through the bore 42.

Figure 35:
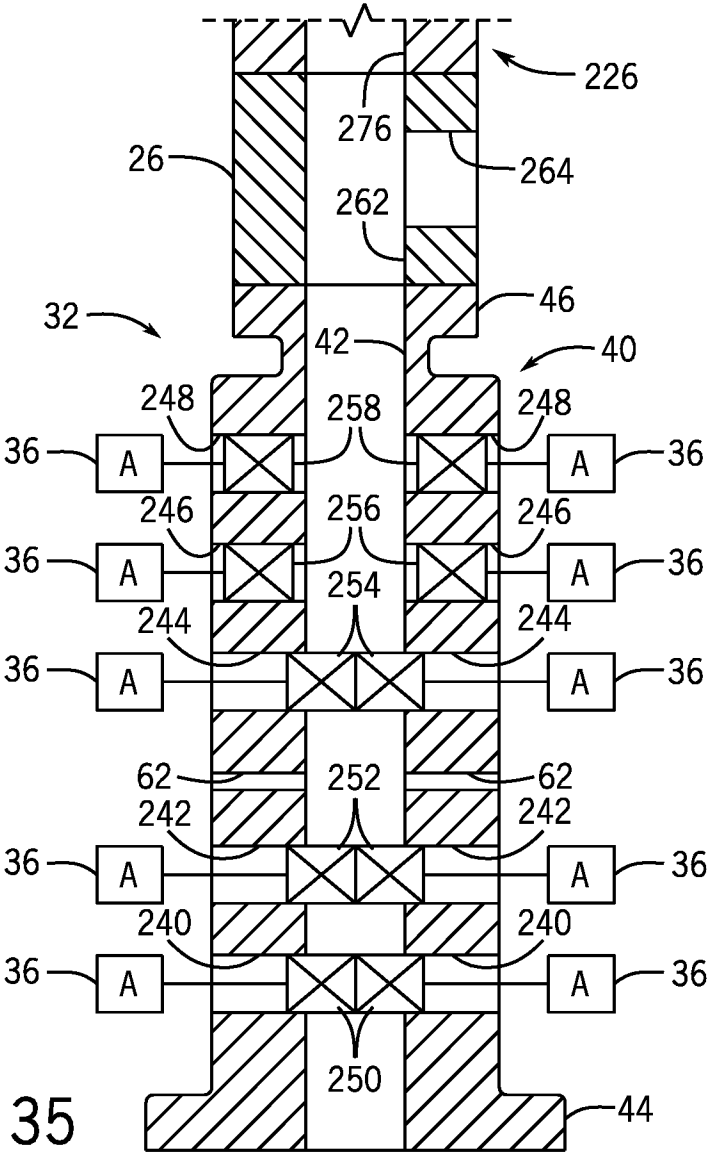
FIG. 35 depicts the frac stack of FIGS. 32 and 33 coupled via a goat head to a lubricator assembly for deploying an intervention tool through the frac stack in accordance with one embodiment.

The tree cap 268 can be removed and the lubricator assembly 226 can be coupled above the frac stack 32. As shown in FIG. 35, for example, the bottom end of the lubricator assembly 226 can be connected to the goat head 26 so that a bore 276 of the lubricator assembly 226 is aligned with the bores 262 and 42 of the goat head 26 and the body 40. In another embodiment generally depicted in FIG. 36, the lubricator assembly 226 is coupled to the body 40 via the goat head 26 and a swab valve 224. Although the swab valve 224 is shown connected above the goat head 26 and below the lubricator assembly 226 in FIG. 36, other arrangements may be used. The swab valve 224 could be positioned below the goat head 26 and above the body 40, for instance. In some instances, the assembly could include multiple swab valves 224. In still another embodiment depicted in FIG. 37, the goat head 26 and swab valve 224 are removed and the lubricator assembly 226 is connected to the upper end of the body 40.

Figure 36:
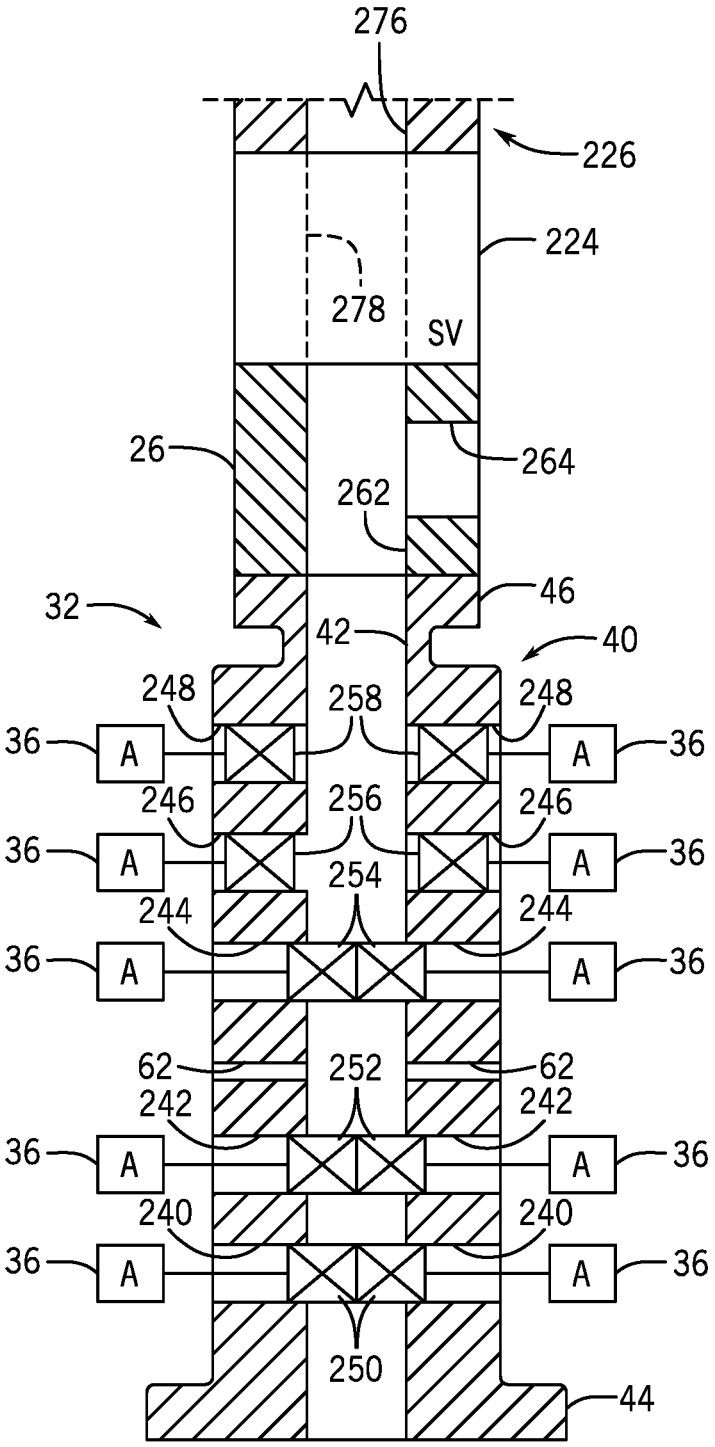
FIG. 36 is similar to FIG. 35 with the addition of a swab valve above the goat head and below the lubricator assembly in accordance with one embodiment.
Figure 37:
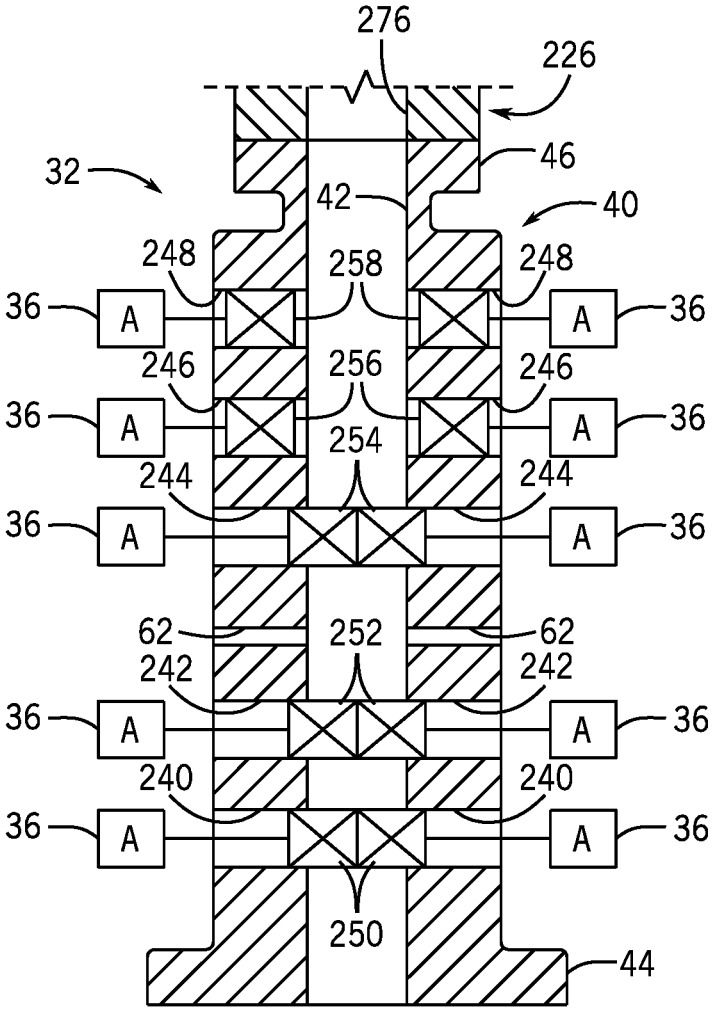
FIG. 37 is similar to FIG. 35 but does not include a goat head in accordance with one embodiment.

Again, in at least some embodiments the lubricator assembly 226 does not include a blowout preventer and is connected to the frac stack 32 without a blowout preventer installed between the lubricator 230 and the fracturing tree 16 (e.g., without a blowout preventer installed between the lubricator 230 and the goat head 26 or swab valve 224 in FIGS. 35-37). In such cases, an intervention tool 212 can be lowered on a line 216 through the bore 42 into the well 12 past intervention rams of the frac stack 32 that can be used to seal about the line 216 and block flow through the bore 42. In at least some embodiments, the rams of the frac stack 32 are positioned below one or more of the goat head 26, the swab valve 224, or a fracturing fluid inlet of the equipment stack. Further, the equipment stack of some embodiments does not include a blowout preventer (e.g., a wireline blowout preventer or coiled tubing blowout preventer) above the frac stack 32 or a blowout preventer (e.g., a drilling blowout preventer) below the frac stack 32. Still further, in some embodiments, the equipment stack does not include any rams above the goat head 26 or above the swab valve 224.

Figure 39:
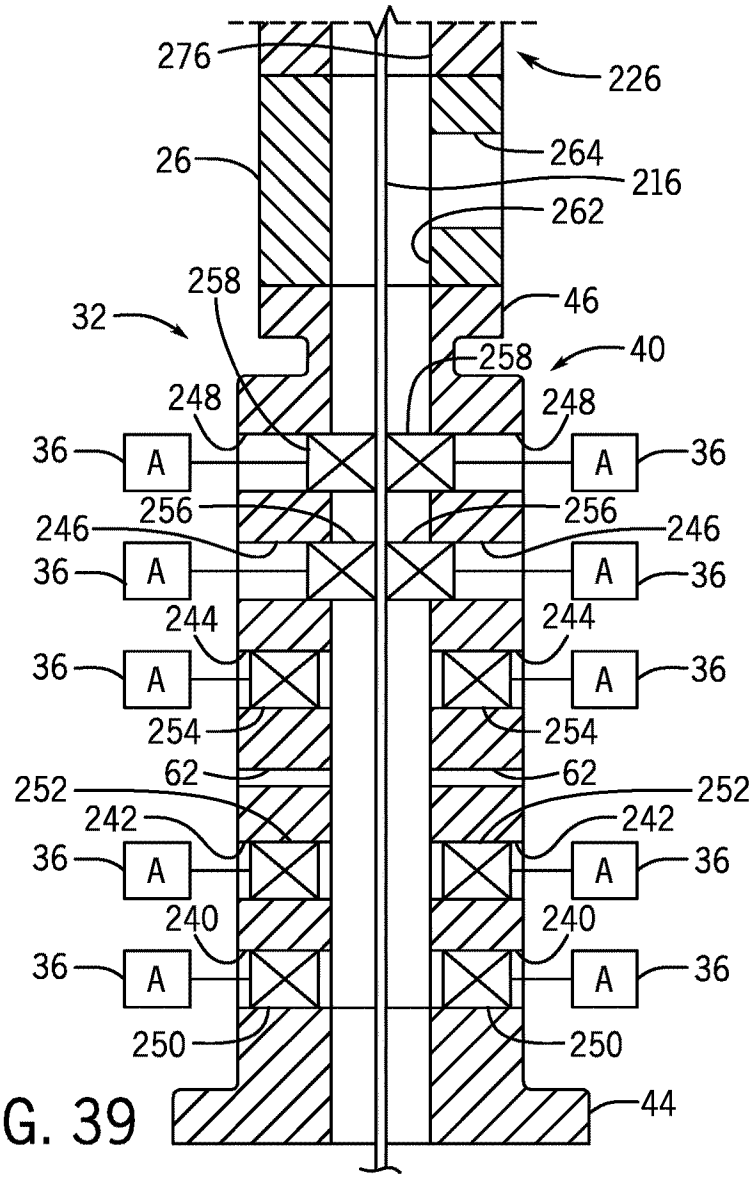
FIG. 39 shows the apparatus of FIG. 38 with intervention rams of the frac stack closed to seal about the line on which the intervention tool is suspended in accordance with one embodiment.
Figure 38:
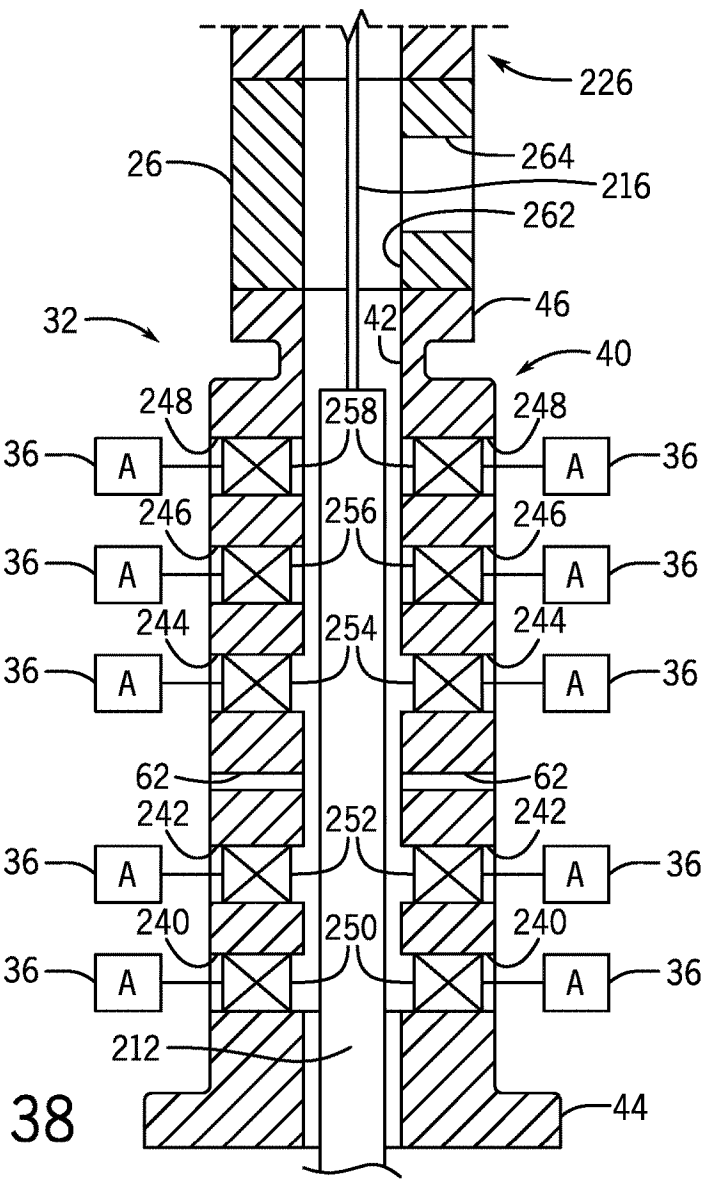
FIG. 38 generally depicts an intervention tool lowered on a line into the frac stack of FIG. 35 from a lubricator in accordance with one embodiment.

An example of the intervention tool 212 being lowered on the line 216 into the well 12 through the frac stack 32 is generally depicted in FIGS. 38 and 39. As noted above, the intervention tool 212 could take various forms depending on the intended function. In some embodiments, the intervention tool 212 can support fracturing operations, such as by perforating downhole casing or setting an isolation plug. With the lubricator assembly 226 mounted above the frac stack 32, the rams 250, 252, 254, 256, and 258 can be opened (as can any swab valve 224 in the equipment stack) to allow the intervention tool 212 to be lowered from the lubricator 230 through goat head 26 and any swab valve 224 (FIG. 36), and then through the bore 42 past the intervention rams (e.g., rams 256 and 258) and blind rams (e.g., rams 250, 252, and 254) into the well 12. With the intervention tool 212 lowered into the well 12, the intervention rams 256 and 258 can be closed to seal around the line 216 and block flow through the bore 42, such as shown in FIG. 39.

In some instances, the intervention rams 256 and 258 serve as a secondary pressure barrier and may remain open during running of the tool 212 into and out of the well 12, such as when performing intervention during low-pressure well conditions. The intervention rams 256 and 258 of some embodiments include wireline rams for sealing around a single-strand or multi-strand wire or cable line 216 (e.g., wireline, slickline, braided line) or pipe rams for sealing around coiled tubing line 216. The intervention tool 212 can be retrieved by raising the tool 212 from the well 12 through the frac stack 32 (past open rams 250, 252, 254, 256, and 258) and back into the lubricator 230.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A well intervention method comprising:

injecting fracturing fluid into a well through a bore of a frac stack coupled to a wellhead, the frac stack including rams that can be moved between open and closed positions to control flow through the bore;

coupling a lubricator to the frac stack without a blowout preventer between the lubricator and the frac stack; and lowering an intervention tool from the lubricator through the bore of the frac stack and into the well.

2. The well intervention method of claim 1, wherein lowering the intervention tool from the lubricator through the bore of the frac stack includes lowering the intervention tool on a line.

3. The well intervention method of claim 2, wherein lowering the intervention tool on the line includes lowering the intervention tool on a wireline, a slickline, a braided line, or a coiled tubing line.

4. The well intervention method of claim 2, wherein the rams of the frac stack include intervention rams that are configured to seal around the line and lowering the intervention tool from the lubricator through the bore of the frac stack includes lowering the intervention tool past the intervention rams of the frac stack.

5. The well intervention method of claim 4, comprising closing the intervention rams of the frac stack to seal around the line and block flow through the bore of the frac stack.

6. The well intervention method of claim 4, wherein the lowering the intervention tool past the intervention rams of the frac stack includes lowering the intervention tool past wireline rams of the frac stack or pipe rams of the frac stack.

7. The well intervention method of claim 4, wherein the frac stack includes a fracturing fluid inlet above the intervention rams and lowering the intervention tool from the lubricator through the bore of the frac stack includes lowering the intervention tool past the fracturing fluid inlet before lowering the intervention tool past the intervention rams of the frac stack.

8. The well intervention method of claim 1, wherein coupling the lubricator to the frac stack without the blowout preventer between the lubricator and the frac stack is performed before injecting the fracturing fluid into the well.

9. The well intervention method of claim 1, wherein lowering the intervention tool from the lubricator through the bore of the frac stack includes lowering at least one of a perforating gun, a plug setting tool, an evaluation tool, or a cleanup tool from the lubricator through the bore of the frac stack.

10. The well intervention method of claim 1, comprising:

uncoupling the lubricator from the frac stack;

coupling the lubricator to an additional frac stack coupled to an additional wellhead at an additional well without a blowout preventer between the lubricator and the additional frac stack; and lowering the intervention tool or an additional intervention tool from the lubricator through the bore of the additional frac stack and into the additional well.

11. The well intervention method of claim 10, comprising closing intervention rams of the additional frac stack to seal around a line by which the intervention tool is lowered and block flow through the bore of the additional frac stack.

12. A well intervention method comprising:

fracturing a well through a frac stack coupled to a wellhead, the frac stack including at least one ram to seal a bore of the frac stack; and lowering an intervention tool on a line through the frac stack, wherein the frac stack includes at least one additional ram to seal about the line in the bore of the frac stack.

13. The well intervention method of claim 12, wherein lowering the intervention tool on the line through the frac stack is performed without lowering the intervention tool through a blowout preventer mounted over the frac stack.

14. The well intervention method of claim 12, wherein the at least one additional ram is present in the frac stack during the fracturing of the well through the frac stack.

15. The well intervention method of claim 12, wherein lowering the intervention tool includes lowering the intervention tool past a goat head connected to route fracturing fluid into the bore of the frac stack.

16. The well intervention method of claim 15, wherein lowering the intervention tool past the goat head includes lowering the intervention tool through the goat head.

17. The well intervention method of claim 15, wherein the at least one additional ram is positioned lower in the frac stack than the goat head.

18. A well intervention system comprising:

a wellhead; and an equipment stack mounted over the wellhead, the equipment stack including:

a ram assembly above the wellhead;

a swab valve above the ram assembly; and a lubricator above the swab valve;

wherein the equipment stack mounted over the wellhead does not include a blowout preventer between the lubricator and the swab valve; wherein the equipment stack includes a bore and is configured to receive fracturing fluid into the bore at a location above the ram assembly and below the swab valve.

19. The well intervention system of claim 18, wherein the equipment stack includes a goat head above the ram assembly and below the swab valve.

* * * * *